US011572219B2

(12) United States Patent
Pawelak

(10) Patent No.: US 11,572,219 B2
(45) Date of Patent: Feb. 7, 2023

(54) ZIPPER CLOSURE AND PACKAGE USING THE SAME

(71) Applicant: Elplast Europe Sp. z o. o., Zory (PL)

(72) Inventor: Marcin Pawelak, Zory (PL)

(73) Assignee: Elplast Europe Sp. Z O.O., Zory (PL)

( * ) Notice: Subject to any disclaimer, the term of this patent is extended or adjusted under 35 U.S.C. 154(b) by 0 days.

(21) Appl. No.: 16/744,394

(22) Filed: Jan. 16, 2020

(65) Prior Publication Data

US 2020/0255188 A1 Aug. 13, 2020

(30) Foreign Application Priority Data

Feb. 8, 2019 (PL) ..... PL428856

(51) Int. Cl.
*B65D 33/25* (2006.01)

(52) U.S. Cl.
CPC ..... *B65D 33/2566* (2013.01); *B65D 33/2541* (2013.01)

(58) Field of Classification Search
CPC ..... B65D 33/25; B65D 33/2508; B65D 33/2516; B65D 33/2525; B65D 33/2533; B65D 33/2541; B65D 33/255; B65D 33/2558; B65D 33/2566; B65D 33/2575; B65D 33/2583; B65D 33/2584; B65D 33/2585; B65D 33/2586; B65D 33/25865; B65D 33/2587; B65D 33/2588; B65D 33/2589; B65D 33/259; B65D 33/2591
USPC ..... 383/61.1, 63–65
See application file for complete search history.

(56) References Cited

U.S. PATENT DOCUMENTS

| | | | |
|---|---|---|---|
| 2,916,197 | A | 12/1959 | Detrie et al. |
| 4,410,130 | A | 10/1983 | Herrington |
| 4,528,224 | A | 7/1985 | Ausnit |
| 4,673,383 | A | 6/1987 | Bentsen |
| 4,736,451 | A | 4/1988 | Ausnit |
| 4,817,188 | A | 3/1989 | Van Erden |

(Continued)

FOREIGN PATENT DOCUMENTS

| | | | |
|---|---|---|---|
| CN | 107074405 | A | 8/2017 |
| EP | 0635433 | A1 | 1/1995 |

(Continued)

OTHER PUBLICATIONS

WO2020137736A1 (Year: 2018).*

(Continued)

*Primary Examiner* — Jes F Pascua
*Assistant Examiner* — Nina K Attel
(74) *Attorney, Agent, or Firm* — Nixon Peabody LLP

(57) ABSTRACT

A zipper closure for use in a package includes first and second closure strips. Each of the first and second closure strips includes at least one closure profile and a flange. The flange of the first closure strip includes outer and inner flange portions. The outer flange portion of the first closure strip encompasses and is integrally connected to the inner flange portion of the first closure strip at a bending point. The inner flange portion of the first closure strip includes the at least one closure profile. The inner flange portion of the first closure strip has a length less than the length of the outer flange portion of the first closure strip. The closure profile of the first closure strip is located between an open end of the inner flange portion and the bending point.

20 Claims, 26 Drawing Sheets

(56) References Cited

U.S. PATENT DOCUMENTS

| | | | |
|---|---|---|---|
| 4,878,763 | A | 11/1989 | Ausnit |
| 4,896,775 | A | 1/1990 | Boeckmann et al. |
| 4,926,526 | A | 5/1990 | Brown et al. |
| 5,007,143 | A | 4/1991 | Herrington |
| 5,017,021 | A | 5/1991 | Simonsen |
| RE33,674 | E | 8/1991 | Uramoto |
| 5,272,794 | A | 12/1993 | Hamatani et al. |
| 5,368,394 | A | 11/1994 | Scott et al. |
| 5,369,847 | A | 12/1994 | Naya et al. |
| 5,527,112 | A | 6/1996 | Dias et al. |
| 5,558,613 | A | 9/1996 | Tilman |
| 5,564,834 | A | 10/1996 | Porchia et al. |
| 5,672,009 | A | 9/1997 | Malin |
| 5,711,609 | A | 11/1998 | Simonsen |
| 5,832,145 | A | 11/1998 | Dais |
| 5,931,582 | A | 8/1999 | Nichols |
| 5,972,396 | A | 10/1999 | Jurgovan |
| 6,004,032 | A | 12/1999 | Kapperman |
| 6,009,603 | A | 1/2000 | Gallagher |
| 6,023,818 | A | 2/2000 | Shang |
| 6,039,182 | A | 3/2000 | Light |
| 6,088,998 | A | 7/2000 | Malin et al. |
| 6,115,892 | A | 9/2000 | Malin |
| 6,149,302 | A | 11/2000 | Taheri |
| 6,185,795 | B1 | 2/2001 | Shui-Shang |
| 6,185,796 | B1 | 2/2001 | Ausnit |
| 6,212,857 | B1 | 4/2001 | Van Erden |
| 6,286,191 | B2 | 9/2001 | Van Erden |
| 6,290,393 | B1 | 9/2001 | Tomic |
| 6,299,353 | B1 | 10/2001 | Piechocki et al. |
| 6,345,911 | B1 | 2/2002 | Young et al. |
| 6,364,530 | B1 | 4/2002 | Buchman |
| 6,376,035 | B1 | 4/2002 | Dobreski et al. |
| 6,385,818 | B1 | 5/2002 | Savicki, Sr. |
| 6,386,760 | B1 | 5/2002 | Tomic |
| 6,527,444 | B1 | 3/2003 | Buchman |
| 6,530,870 | B2 | 3/2003 | Buchman |
| 6,550,965 | B2 | 4/2003 | Shaffer |
| 6,588,176 | B1 | 7/2003 | Buchman |
| 6,698,925 | B2 | 3/2004 | Bentsen |
| 6,733,178 | B2 | 5/2004 | Bois |
| 6,751,932 | B1 | 6/2004 | Matthews |
| 6,783,276 | B2 | 8/2004 | Machacek |
| 6,799,890 | B2 | 10/2004 | Schneider |
| 6,843,600 | B2 | 1/2005 | Tilman |
| 6,846,108 | B2 | 1/2005 | Buchman |
| 6,863,646 | B2 | 3/2005 | Kinigakis |
| 6,955,465 | B2 | 10/2005 | Machacek |
| 7,004,630 | B2 | 2/2006 | Piechocki |
| 7,029,178 | B2 | 4/2006 | Gzybowski |
| 7,048,442 | B2 | 5/2006 | Schneider |
| 7,137,736 | B2 | 11/2006 | Pawloski |
| 7,182,513 | B1 | 2/2007 | Malin |
| 7,223,017 | B2 | 5/2007 | Weaver |
| 7,249,887 | B2 | 7/2007 | Kinigakis |
| 7,316,101 | B1 | 1/2008 | Nguyen et al. |
| 7,410,298 | B2 | 8/2008 | Pawloski |
| 7,437,805 | B2 | 10/2008 | Berich |
| 7,494,280 | B2 | 2/2009 | Gzybowski |
| 7,506,417 | B2 | 3/2009 | Yoneoka |
| 7,574,781 | B2 | 8/2009 | Ackerman |
| 7,674,039 | B2 | 3/2010 | McMahon et al. |
| 7,726,880 | B2 | 6/2010 | Zimmerman |
| 7,784,160 | B2 | 8/2010 | Dais |
| 7,798,714 | B2 | 9/2010 | Zimmerman |
| 7,850,368 | B2 | 12/2010 | Pawloski |
| 7,871,481 | B2 | 1/2011 | Kasai |
| 7,886,412 | B2 | 2/2011 | Dais |
| 7,967,509 | B2 | 6/2011 | Turvey et al. |
| 8,011,831 | B2 | 9/2011 | Tanaka et al. |
| 8,066,434 | B2 | 11/2011 | Nanba |
| 8,118,489 | B2 | 2/2012 | Waldron et al. |
| 8,192,085 | B2 | 6/2012 | Pawloski et al. |
| 8,202,002 | B2 | 6/2012 | McMahon et al. |
| 8,550,716 | B2 | 10/2013 | Smith et al. |
| 8,646,972 | B2 | 2/2014 | Tanaka et al. |
| 8,893,356 | B2 | 11/2014 | Ozaki et al. |
| 9,011,003 | B2 | 4/2015 | Pawloski |
| 9,022,003 | B2 | 5/2015 | Grover, Jr. et al. |
| 9,174,774 | B2 | 11/2015 | Peplinski |
| 9,284,097 | B2 | 3/2016 | Heckman |
| 9,365,326 | B2 | 6/2016 | Henri |
| 9,469,423 | B2 | 10/2016 | Thomas, Jr. et al. |
| 9,516,927 | B2 | 12/2016 | Turvey |
| 9,573,730 | B2 | 2/2017 | Heckman |
| 9,624,004 | B2 | 4/2017 | Kent et al. |
| 9,878,828 | B2 | 1/2018 | Turvey |
| 9,896,241 | B2 | 2/2018 | Anzini |
| 9,950,842 | B2 | 4/2018 | Turvey |
| 9,957,087 | B2 | 5/2018 | Takigawa |
| 9,969,534 | B2 | 5/2018 | Kent et al. |
| 10,005,592 | B2 | 6/2018 | Takigawa |
| 10,011,403 | B1 | 7/2018 | Kirsh |
| 10,011,404 | B1 | 7/2018 | Kirsh |
| 10,029,826 | B2 | 7/2018 | Petkovsek |
| 10,093,456 | B2 | 10/2018 | Georges et al. |
| 10,093,458 | B2 | 10/2018 | Stave et al. |
| 10,118,737 | B2 | 11/2018 | Septien Rojas |
| 10,189,607 | B2 | 1/2019 | Tseng et al. |
| 10,287,063 | B2 | 5/2019 | Septien Rojas et al. |
| 10,293,985 | B2 | 5/2019 | Turvey |
| 10,315,807 | B2 | 6/2019 | Septien Rojas |
| 10,351,306 | B2 | 7/2019 | Septien Rojas et al. |
| 10,384,835 | B2 | 8/2019 | Sprehe |
| 10,427,839 | B2 | 10/2019 | Johnston |
| 10,507,959 | B2 | 12/2019 | Kirsh |
| 10,513,372 | B2 | 12/2019 | Wang |
| 10,543,959 | B2 | 1/2020 | Turvey |
| 10,597,198 | B2 | 3/2020 | Dais |
| 10,676,243 | B2 | 6/2020 | Turvey |
| 10,689,162 | B2 | 6/2020 | Tameda et al. |
| 10,759,569 | B2 | 9/2020 | Sprehe |
| 10,781,014 | B2 | 9/2020 | Turvey |
| 10,906,701 | B2 | 2/2021 | Todaka |
| 10,994,896 | B2 | 5/2021 | Turvey |
| 11,203,463 | B2 | 12/2021 | Septien Rojas |
| 11,511,914 | | 11/2022 | Hansen et al. |
| 2001/0002218 | A1 | 5/2001 | Shaffer et al. |
| 2002/0034339 | A1 | 3/2002 | Bois |
| 2002/0090489 | A1 | 7/2002 | Dobreski et al. |
| 2002/0094137 | A1 | 7/2002 | Schneider |
| 2002/0162200 | A1 | 11/2002 | Offa-Jones |
| 2002/0196987 | A1 | 12/2002 | Tilman |
| 2003/0014848 | A1 | 1/2003 | LaRu et al. |
| 2003/0054931 | A1 | 3/2003 | Buchman |
| 2003/0103687 | A1 | 6/2003 | Schneider |
| 2003/0103688 | A1 | 6/2003 | Schneider |
| 2003/0103689 | A1 | 6/2003 | Schneider |
| 2003/0103690 | A1 | 6/2003 | Schneider |
| 2003/0138171 | A1 | 7/2003 | Kikuchi |
| 2003/0167607 | A1 | 9/2003 | Linton |
| 2003/0172622 | A1 | 9/2003 | Kinigakis |
| 2003/0215163 | A1 | 11/2003 | Schneider et al. |
| 2004/0064923 | A1 | 4/2004 | Gzybowski |
| 2004/0078938 | A1 | 4/2004 | Pawloski |
| 2004/0078939 | A1 | 4/2004 | Pawloski |
| 2004/0091186 | A1 | 5/2004 | Shibata |
| 2004/0120610 | A1 | 6/2004 | Buchman |
| 2004/0131283 | A1 | 7/2004 | Sprague |
| 2004/0161169 | A1 | 8/2004 | Fenzl et al. |
| 2004/0161170 | A1 | 8/2004 | Linton et al. |
| 2004/0161178 | A1 | 8/2004 | Olechowski |
| 2005/0063617 | A1 | 3/2005 | Tilman |
| 2005/0196076 | A1 | 9/2005 | Tanaka et al. |
| 2005/0271308 | A1 | 12/2005 | Pawloski |
| 2005/0281487 | A1 | 12/2005 | Pawloski et al. |
| 2005/0286810 | A1 | 12/2005 | Sprague |
| 2005/0286811 | A1 | 12/2005 | Sprague |
| 2005/0286812 | A1 | 12/2005 | Sprague |
| 2006/0008186 | A1 | 1/2006 | Kusz |
| 2006/0029299 | A1 | 2/2006 | Share et al. |
| 2006/0104550 | A1 | 5/2006 | Kuge et al. |
| 2006/0111226 | A1 | 5/2006 | Anzini |

(56) References Cited

U.S. PATENT DOCUMENTS

| | | | | |
|---|---|---|---|---|
| 2006/0165316 | A1* | 7/2006 | Cheung | B65D 33/2541 383/63 |
| 2006/0210201 | A1 | 9/2006 | Ackerman | |
| 2006/0222744 | A1 | 10/2006 | Peplinski | |
| 2006/0228055 | A1 | 10/2006 | Eads et al. | |
| 2003/0285777 | | 12/2006 | Howell | |
| 2007/0033776 | A1 | 2/2007 | Yoneoka | |
| 2007/0130733 | A1 | 6/2007 | Kasai | |
| 2007/0183692 | A1 | 8/2007 | Pawloski | |
| 2007/0297698 | A1 | 12/2007 | Berich | |
| 2008/0050052 | A1 | 2/2008 | Anzini et al. | |
| 2008/0159663 | A1 | 7/2008 | Pham | |
| 2008/0226203 | A1 | 9/2008 | Dais et al. | |
| 2008/0232722 | A1 | 9/2008 | Pawloski | |
| 2009/0067760 | A1 | 3/2009 | Shelley et al. | |
| 2010/0014786 | A1 | 1/2010 | Pawloski | |
| 2010/0014787 | A1 | 1/2010 | Katada et al. | |
| 2010/0046860 | A1 | 2/2010 | Kent et al. | |
| 2010/0069211 | A1 | 3/2010 | Anzini et al. | |
| 2010/0150477 | A1 | 6/2010 | Bois | |
| 2010/0208020 | A1 | 8/2010 | Matsumoto | |
| 2010/0209020 | A1 | 8/2010 | Delasalle | |
| 2010/0226599 | A1 | 9/2010 | Katada et al. | |
| 2010/0236026 | A1 | 9/2010 | Nanba et al. | |
| 2010/0290719 | A1 | 11/2010 | Yeager | |
| 2011/0044565 | A1 | 2/2011 | Pawloski et al. | |
| 2011/0069912 | A1 | 3/2011 | Waldron et al. | |
| 2011/0103717 | A1 | 5/2011 | Kasai | |
| 2011/0126384 | A1 | 6/2011 | Ozaki et al. | |
| 2011/0311168 | A1 | 12/2011 | Pawloski | |
| 2012/0045151 | A1 | 2/2012 | Eouzan | |
| 2012/0189232 | A1 | 7/2012 | Anzini et al. | |
| 2012/0255520 | A1 | 10/2012 | Grover, Jr. et al. | |
| 2012/0314978 | A1 | 12/2012 | Tamaoki et al. | |
| 2012/0321225 | A1 | 12/2012 | Goto | |
| 2013/0030550 | A1 | 1/2013 | Jopek et al. | |
| 2013/0305500 | A1 | 11/2013 | Rojas | |
| 2014/0161374 | A1 | 6/2014 | Rojas | |
| 2014/0259559 | A1 | 9/2014 | VanLoocke | |
| 2014/0270580 | A1 | 9/2014 | Thomas, Jr. et al. | |
| 2014/0270585 | A1 | 9/2014 | Heckman | |
| 2014/0270586 | A1 | 9/2014 | Petkovsek | |
| 2014/0294325 | A1 | 10/2014 | Anzini | |
| 2014/0311101 | A1 | 10/2014 | Petkovsek et al. | |
| 2014/0311102 | A1 | 10/2014 | Petkovsek et al. | |
| 2015/0266622 | A1 | 9/2015 | Tseng et al. | |
| 2016/0088906 | A1 | 3/2016 | Jin | |
| 2016/0101904 | A1 | 4/2016 | Takigawa | |
| 2016/0107801 | A1 | 4/2016 | Armstrong | |
| 2016/0122087 | A1 | 5/2016 | Takigawa | |
| 2016/0221723 | A1* | 8/2016 | Tseng | B65D 33/007 |
| 2017/0152085 | A1 | 6/2017 | Rojas | |
| 2017/0190476 | A1 | 7/2017 | Goto | |
| 2017/0217650 | A1 | 8/2017 | Steele | |
| 2017/0253386 | A1 | 9/2017 | Stave et al. | |
| 2017/0275055 | A1 | 9/2017 | Martial | |
| 2018/0029755 | A1* | 2/2018 | Tseng | B29C 48/265 |
| 2018/0044067 | A1 | 2/2018 | Rojas | |
| 2018/0118414 | A1 | 5/2018 | Martial | |
| 2018/0257820 | A1 | 9/2018 | Tameda et al. | |
| 2018/0273257 | A1 | 9/2018 | Kirsh | |
| 2018/0312301 | A1 | 11/2018 | Martial | |
| 2018/0312302 | A1 | 11/2018 | Septien Rojas et al. | |
| 2018/0319546 | A1 | 11/2018 | Liu | |
| 2018/0362220 | A1 | 12/2018 | Wang | |
| 2020/0198842 | A1* | 6/2020 | Hansen | B65D 33/25 |
| 2020/0198843 | A1 | 6/2020 | Hansen | |
| 2020/0231340 | A1 | 7/2020 | Septien Rojas | |
| 2020/0239195 | A1 | 7/2020 | Hansen | |
| 2021/0114777 | A1 | 4/2021 | Lee | |
| 2021/0214128 | A1 | 7/2021 | Turvey | |
| 2021/0284394 | A1 | 9/2021 | Hansen | |
| 2022/0112002 | A1 | 4/2022 | Oike | |

FOREIGN PATENT DOCUMENTS

| | | | | |
|---|---|---|---|---|
| EP | 0985605 | | 3/2000 | |
| EP | 2 218 650 | A1 | 8/2010 | |
| EP | 1 489 019 | A1 | 12/2014 | |
| EP | 3015395 | A1 | 4/2016 | |
| EP | 3360815 | A1 | 8/2018 | |
| EP | 3 904 228 | A1 | 11/2021 | |
| GB | 841 142 | A | 7/1960 | |
| GB | 2 424 868 | A | 10/2006 | |
| JP | 3094269 | B2 | 10/2000 | |
| JP | 2001314207 | A | 11/2001 | |
| JP | 2003080458 | A | 3/2003 | |
| JP | 2016043973 | A | 4/2016 | |
| JP | 2017210258 | A | 11/2017 | |
| JP | 2020099607 | A * | 7/2020 | B65D 33/25 |
| NL | 2021415 | B1 | 2/2020 | |
| PL | 64476 | Y1 | 6/2009 | |
| WO | WO 2009/089019 | A1 | 7/2009 | |
| WO | WO 2014/066025 | A1 | 5/2014 | |
| WO | WO 2016/034720 | A1 | 3/2016 | |
| WO | WO 2017/051771 | | 3/2017 | |
| WO | WO 2017/087359 | A1 | 5/2017 | |
| WO | WO 2020/137736 | | 7/2020 | |

OTHER PUBLICATIONS

WO2020137736A1 Translation (Year: 2018).*

Extended European Search Report in European Patent Application No. EP 20156329.3, dated Jul. 15, 2020 (5 pages).

"IMPAK's Child Resistant Pouches" Sorbent Systems online presence of IMPAK Corporation, retrieved Dec. 4, 2022, 6 pp. https://web.archive.org/web/20170627042106/http:/www.sorbentsystems.com/child-resistant-pouches.html.

Child-Resistant Bags with "Thumb-Pocket" Zipper, IMPAK Corporation, vimeo, retrieved Dec. 5, 2022, 3 pp. https://vimeo.com/244095106.

* cited by examiner

ZIPPER CLOSURE AND PACKAGE USING THE SAME

CROSS-REFERENCE TO RELATED APPLICATION

This application claims the benefit of priority of PL428856 entitled "A zipper closure with protection against opening and a package comprising a zipper closure with protection against opening" filed in Poland on Feb. 8, 2019, which is incorporated by reference in its entirety.

FIELD OF THE INVENTION

The present invention relates generally to a zipper closure for opening and closing a bag or package. More specifically, the zipper closure of the present invention protects against unauthorized opening.

BACKGROUND OF THE INVENTION

Recloseable zipper closures or fasteners that are attached to a bag or package have existed for years. Some recloseable zipper closures or fasteners use strips that are opened by pulling the strips apart and closing them by pressing them together. Other recloseable zipper closures or fasteners use slider mechanisms that open and close the bag or package.

The recloseable bags or packages may contain items therein at the point of sale. Some bags or packages contain items that may not be suited for certain individuals, especially children. Some recloseable arrangements are relatively easy to open. Some recloseable arrangements make opening the bag or the package very difficult, but such arrangements can lead to vigorous attempts to open that can potentially rupture the bag or package.

It would be desirable to have recloseable zipper closures that assist in preventing or inhibiting unauthorized opening of the bag or package, while still performing all of the desired properties of a recloseable zipper closure. It would also be desirable to have such recloseable zipper closures that are simple and efficient to manufacture, and can be easily and cost efficiently applied to bags and packages.

SUMMARY OF THE INVENTION

A zipper closure for use in a package includes a first closure strip and a second closure strip. The first closure strip includes at least one closure profile and a flange. The second closure strip includes at least one closure profile and a flange. The flange of the first closure strip includes an outer flange portion and an inner flange portion. The outer flange portion of the first closure strip encompasses and is integrally connected to the inner flange portion of the first closure strip at a bending point. The inner flange portion of the first closure strip includes the at least one closure profile. The inner flange portion of the first closure strip has a length less than the length of the outer flange portion of the first closure strip. The at least one closure profile of the first closure strip and the at least one closure profile of the second closure strip are configured to interlock with each other. The at least one closure profile of the first closure strip is located between an open end of the inner flange portion of the first closure portion and the bending point.

A zipper closure for use in a package includes a first closure strip and a second closure strip. The first closure strip includes at least one closure profile and a flange. The second closure strip includes at least one closure profile and a flange. The flange of the first closure strip includes an outer flange portion and an inner flange portion. The outer flange portion of the first closure strip encompasses and is integrally connected to the inner flange portion of the first closure strip at a bending point. The inner flange portion of the first closure strip includes the at least one closure profile. The at least one closure profile of the first closure strip and the at least one closure profile of the second closure strip are configured to interlock with each other. The at least one closure profile of the first closure strip and the at least one closure profile of the second closure strip are configured to be unlocked by grasping and moving the second closure strip and the inner flange portion of the first closure strip from each other. The at least one closure profile of the first closure strip is located between an open end of the inner flange portion of the first closure portion and the bending point.

A package includes first and second opposing body panels, and a zipper closure. The first and second opposing body panels are fixedly connected to each other along a pair of sides and a bottom bridging the pair of sides. The zipper closure extends along a mouth formed opposite of the bottom. The zipper closure includes a first closure strip and a second closure strip. The first closure strip includes at least one closure profile and a flange. The second closure strip includes at least one closure profile and a flange. The flange of the first closure strip includes an outer flange portion and an inner flange portion. The outer flange portion of the first closure strip encompasses and is integrally connected to the inner flange portion of the first closure strip at a bending point. The inner flange portion of the first closure strip includes the at least one closure profile. The inner flange portion of the first closure strip has a length less than the length of the outer flange portion of the first closure strip. The at least one closure profile of the first closure strip and the at least one closure profile of the second closure strip are configured to interlock with each other. The at least one closure profile of the first closure strip is located between an open end of the inner flange portion of the first closure portion and the bending point. The at least one closure profile of the first closure strip and the at least one closure profile of the second closure strip are configured to be unlocked by grasping and moving the second closure strip and the inner flange portion of the first closure strip from each other so as to open the package.

A package comprises first and second opposing body panels and a zipper closure. The first and second opposing body panels are fixedly connected to each other along a pair of sides and a bottom bridging the pair of sides. The zipper closure extends along a mouth formed opposite of the bottom. The zipper closure includes a first closure strip and a second closure strip. The first closure strip includes at least one closure profile and a flange. The second closure strip includes at least one closure profile and a flange. The flange of the first closure strip includes an outer flange portion and an inner flange portion. The outer flange portion of the first closure strip encompasses and is integrally connected to the inner flange portion of the first closure strip at a bending point. The inner flange portion of the first closure strip includes the at least one closure profile. The at least one closure profile of the first closure strip and the at least one closure profile of the second closure strip are configured to interlock with each other. The at least one closure profile of the first closure strip and the at least one closure profile of the second closure strip are configured to be unlocked by grasping and moving the second closure strip and the inner flange portion of the first closure strip from each other. The at least one closure profile of the first closure strip is located between an open end of the inner flange portion of the first closure portion and the bending point.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
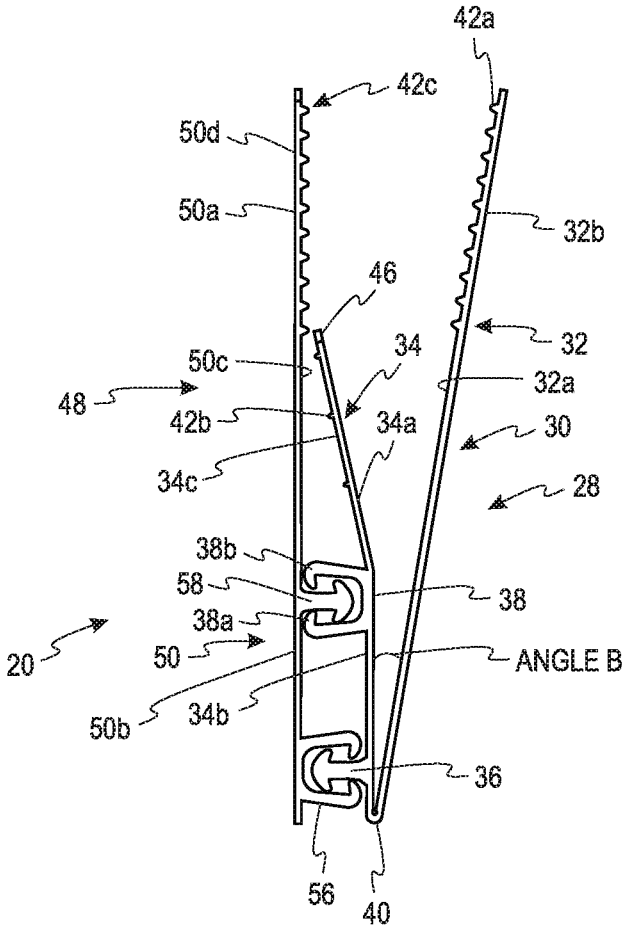
FIG. 1A shows a cross-sectional view (without cross-hatching for better clarity) of a zipper closure according to one embodiment.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Referring to FIG. 1A, a zipper closure 20 is shown in a cross-sectional view according to one embodiment. For improved clarity, the cross-sectional views have been drawn without cross-hatching. The zipper closures of the present invention are desirably formed to assist in preventing or inhibiting unauthorized opening of the bag or package. The configuration of zipper closure 20 provides a balance between an easily openable package that requires little force to open and a package with closure profiles being tightly clamped in which a vigorous opening may rupture the package.

The zipper closure 20 includes a first closure strip 28 and a second closure strip 48. The first closure strip 28 includes a flange 30, a first closure profile 36 and a second closure profile 38. The flange 30 includes a first flange portion or outer flange portion 32 and a second flange portion or inner flange portion 34. The inner flange portion 34 includes the first closure profile 36 and the second closure profile 38, which are configured to interlock with respective first and second closure profiles 56, 58 of the second closure strip 48. As shown in FIG. 1A, the inner flange portion 34 includes an inner flange section 34*a* that extends above the first and second closure profiles 36, 38, and an inner flange section 34*b* that extends between the first and second closure profiles 36, 38.

The first closure profile 36 is a male profile with a cross-section being arrowhead-shaped. The second closure profile 38 is a female profile with a cross-section that is generally U-shaped. The second closure profile 38 also includes ends of its arms 38*a*, 38*b* being bent generally inward. It is contemplated that the first and second closure profiles may be other shapes and dimensions than depicted.

By using an increased number of closure profiles in the closure strip (e.g., first and second closure profiles 36, 38 of FIG. 1A), the risk of an uncontrolled opening is diminished and simultaneously the tightness of the zipper closure is improved. Additionally, if a plurality of closure profiles is used, the closing force of the zipper closure can be increased by alternating the different closure profile types on each side of the closure strip. For example, referring still to FIG. 1A, the first closure strip 28 has the first closure profile 36 being a male closure and the second closure profile 38 being a female closure.

It is contemplated that the closure strips of the present invention may include the same type of closure profile that corresponds and interlocks with a different type of closure profile on the opposing closure strip. For example, the first closure strip may include a plurality of male closures, while the second closure strip may include a plurality of female closures.

The outer flange portion 32 encompasses and is integrally connected with the inner flange portion 34 at a bending point 40. In the orientation of FIG. 1A, the bending point 40 is slightly below the first closure profile 36. The first and second closure profiles 36, 38 of FIG. 1A are located between an open end 46 of the inner flange portion 34 and the bending point 40.

Figure 1B:
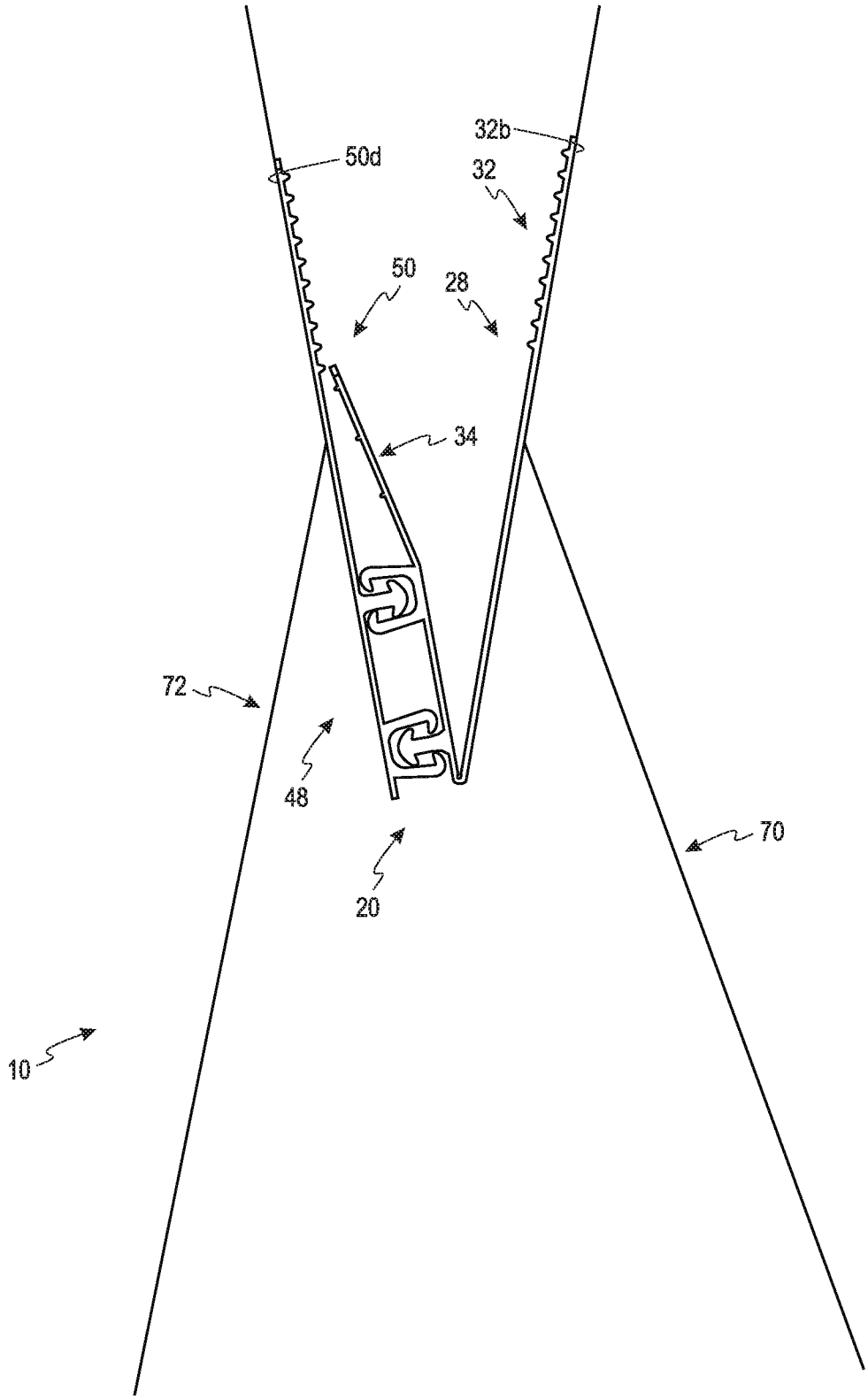
FIG. 1B shows a cross-sectional view of the zipper closure of FIG. 1A being used in a polymeric bag or package according to one embodiment.

In one process, the outer flange portion 32 and the inner flange portion 34 are formed and then bent so as to be located in their respective positions of FIGS. 1A, 1B. As shown in FIG. 1A, the inner flange portion 34 and the outer flange portion 32 are generally at an angle B of from about 5 to about 60 degrees and, more specifically, from about 15 to about 50. The inner flange portion 34 and the outer flange portion 32 are typically at an angle B of from about 25 to about 40 degrees.

The length of the inner flange portion 34 is shorter than the length of the outer flange portion 32 as shown in FIG. 1A. Having the length of the inner flange portion 34 being shorter than the length of the outer flange portion 32 makes opening of the zipper closure 20 more difficult, especially for children. By making the inner flange portion 34 with the first and second profile closures 36, 38 shorter, it also makes it more difficult for a child to locate the correct flange portion to open the bag or package since the shorter inner flange portion is relatively hidden as compared to the longer outer flange portion.

The length of an outer flange portion is generally from about 15 to about 30 mm and, more specifically, from about 18 to about 25 mm. The length of an inner flange portion is generally from about 8 to about 14 mm and, more specifically, from about 10 to about 12 mm. The length of the inner flange portion is generally from about 30 to about 80 percent of the length of the outer flange portion. More specifically, the length of the inner flange portion is generally from about 40 to about 70 percent of the length of the outer flange portion. The length of the inner flange portion is typically from about 40 to about 60 percent of the length of the outer flange portion.

As shown in FIG. 1B, the inner flange portion 34 is even less accessible because it is bent and located in close proximity to a flange 50 of the second closure strip 48. The position of the inner flange portion 34 of the first closure strip 28 in FIG. 1B is a child-resistant position.

Reinforcing notches may be optionally added to the zipper closures of the present invention. The reinforcing notches assist in making the zipper closures more resistant to the forces occurring during repeated opening and closing of the bags or packages. The reinforcing notches also can assist a user in opening the bag or package by providing an improved gripping area.

Referring back to FIG. 1A, reinforcing notches 42*a* are located on an inner surface 32*a* of the outer flange portion 32, while reinforcing notches 42*b* are located on a surface 34*c* of the inner flange portion 34.

The second closure strip 48 of the zipper closure 20 includes the flange 50, the first closure profile 56 and the second closure profile 58. As shown in FIG. 1A, the flange 50 of the second closure strip 48 includes a flange section 50*a* that extends above the first and second closure profiles 56, 58, and a flange section 50*b* that extends between the first and second closure profiles 56, 58. Reinforcing notches 42*c* are located on an inner surface 50*c* of the flange 50.

It is contemplated that the closure strips of the present invention may be formed without any reinforcing notches. It is also contemplated that, if used, the reinforcing notches may be formed in a different number and/or location than shown in FIG. 1A.

The outer flange portion 32 of the first closure strip 28 includes an exterior or outer surface 32*b* that is adapted to be attached (e.g., heat-sealed) with a bag or package. The flange 50 of the second closure strip 48 includes an exterior or outer surface 50*d* that is adapted to be attached (e.g., heat-sealed) with a bag or package.

In another method, the zipper closure may be attached to an inner surface of a bag or package by using an adhesive. In one non-limiting example, the adhesive may be in the form of an adhesive layer.

In another method, the location where the zipper closure is heat-sealed with the package may also be covered with an adhesive layer (e.g., an adhesive layer with adhesive notches). The use of the adhesive layer may additionally strengthen the attachment or joint between the zipper closure and the package.

One non-limiting example of a zipper closure being attached to a bag or package is shown in FIG. 1B. FIG. 1B depicts the zipper closure 20 being attached to first and second opposing body panels 70, 72 to form a bag or package 10. Specifically, the exterior surface area 32*b* of the outer flange portion 32 is attached to the first body panel 70, while the exterior surface 50*d* of the flange section 50*a* is attached to the second body panel 72 in forming the bag or package 10. As shown in FIG. 1B, the attachments to the first and second body panels 70, 72 are performed at the respective top portions of the first and second closure strips 28, 48 (i.e., at a location away from the profiles). The attachment may be performed using, for example, heat sealing or adhesives.

Figure 1C:
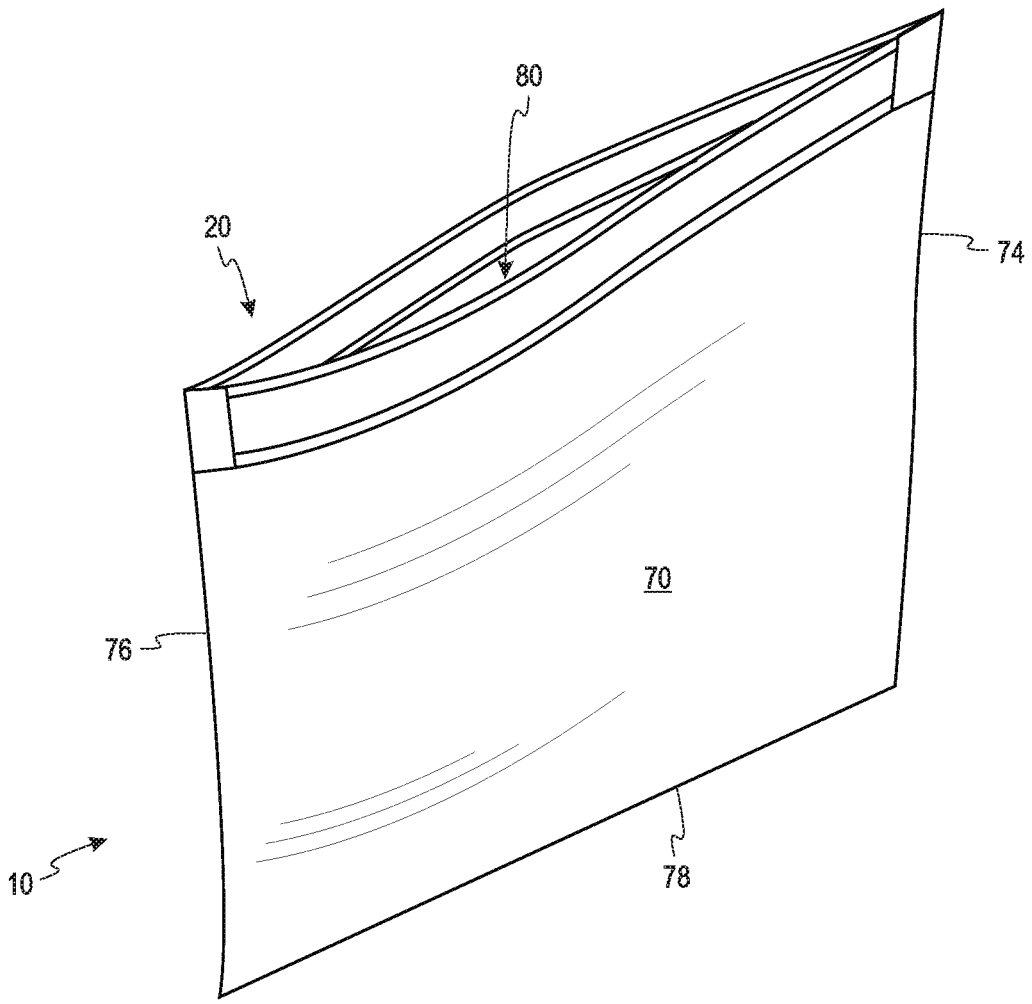
FIG. 1C shows a perspective view of the zipper closure of FIG. 1A and the entire polymeric bag or package of FIG. 1B.

Referring to FIG. 1C, the entire bag or package 10 is shown with the zipper closure 20. The bag or package 10 includes the first and second opposing body panels 70, 72 (only the first body panel 70 is shown in FIG. 1C) being fixedly connected to each other along a pair of sides 74, 76 and a bottom 78 bridging the pair of sides 74, 76. The bag or package 10 is provided with the zipper closure 20 extending along a mouth portion 80 formed opposite the closed bottom 78 of the polymeric bag or package.

Figure 2A:
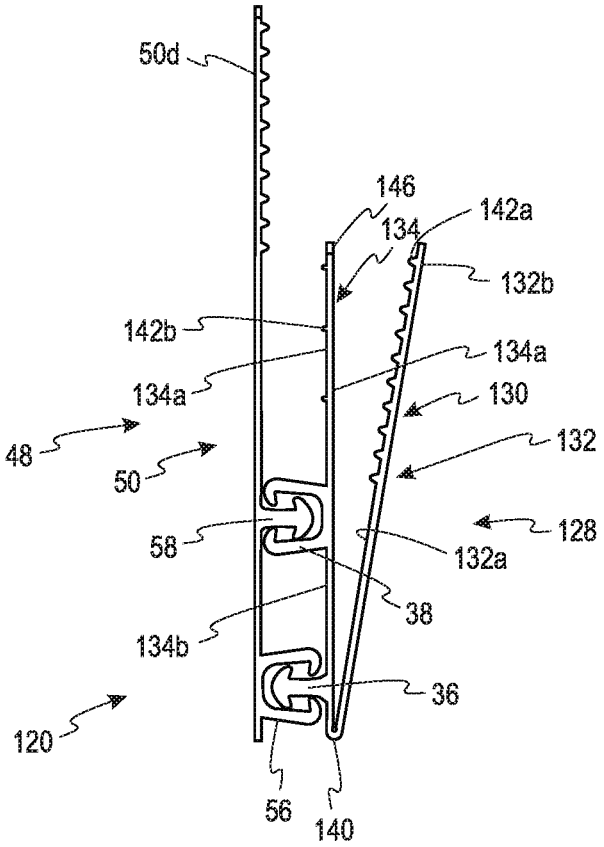
FIG. 2A shows a cross-sectional view of a zipper closure according to another embodiment.
Figure 2B:
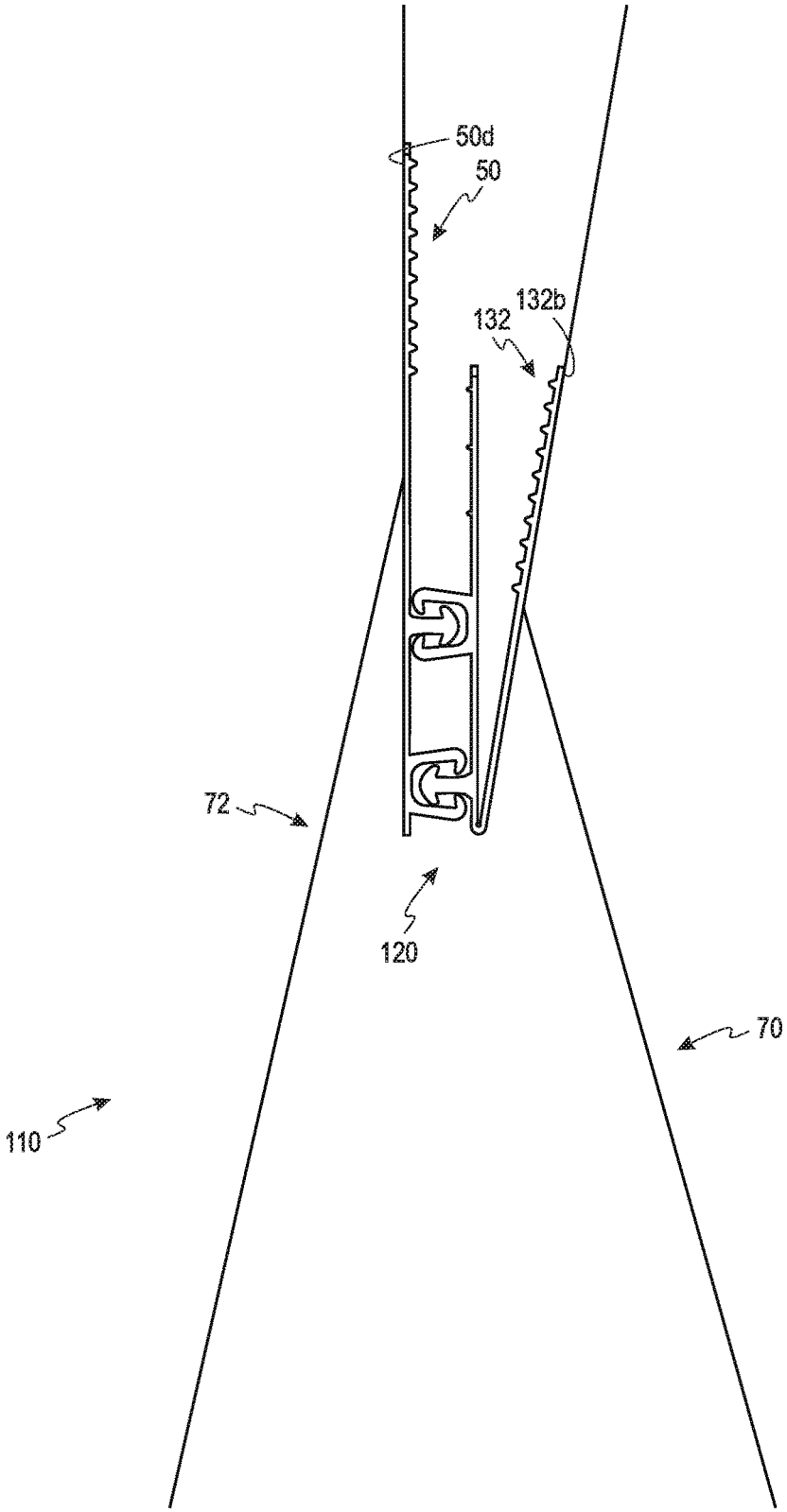
FIG. 2B shows a cross-sectional view of the zipper closure of FIG. 2A being used in a polymeric bag or package according to one embodiment.

Referring to FIGS. 2A, 2B, a zipper closure 120 includes a first closure strip 128 and the second closure strip 48. The second closure strip 48 is described with respect to FIGS. 1A, 1B. The first closure strip 128 includes a flange 130, the first closure profile 36 and the second closure profile 38. The flange 130 includes a first flange portion or outer flange portion 132 and a second flange portion or inner flange portion 134. The outer flange portion 132 and the inner flange portion 134 are of the same length.

As shown in FIG. 2A, the inner flange portion 134 includes an inner flange section 134*a* that extends above the first and second closure profiles 36, 38, and an inner flange section 134*b* that extends between the first and second closure profiles 36, 38. The outer flange portion 132 encompasses and is integrally connected with the inner flange portion 134 at a bending point 140. In the orientation of FIG. 2A, the bending point 140 is slightly below the first closure profile 36. The first and second closure profiles 36, 38 of FIG. 2A are located between an open end 146 of the inner flange portion 134 and the bending point 140.

Reinforcing notches 142*a* are located on an inner surface 132*a* of the outer flange portion 132, while reinforcing notches 142*b* are located on a surface 134*a* of the inner flange portion 134. The outer flange portion 132 of the first closure strip 128 includes an exterior or outer surface 132*b* that is adapted to be attached (e.g., heat-sealed) with a bag or package. The flange 50 of the second closure strip 48 includes the exterior or outer surface 50*d* that is adapted to be attached (e.g., heat-sealed) with a bag or package.

FIG. 2B shows the zipper closure 120 being attached to the first and second opposing body panels 70, 72 to form a bag or package 110. Specifically, the exterior surface 132*b* of the outer flange portion 132 is attached the first body panel 70, while the exterior surface 50*d* of the flange 50 is attached to the second body panel 72 in forming the bag or package 110 as shown in FIG. 2B. As discussed above, the attachment of the closures to the opposing body panels may be performed using, for example, heat sealing or adhesives.

Figure 3A:
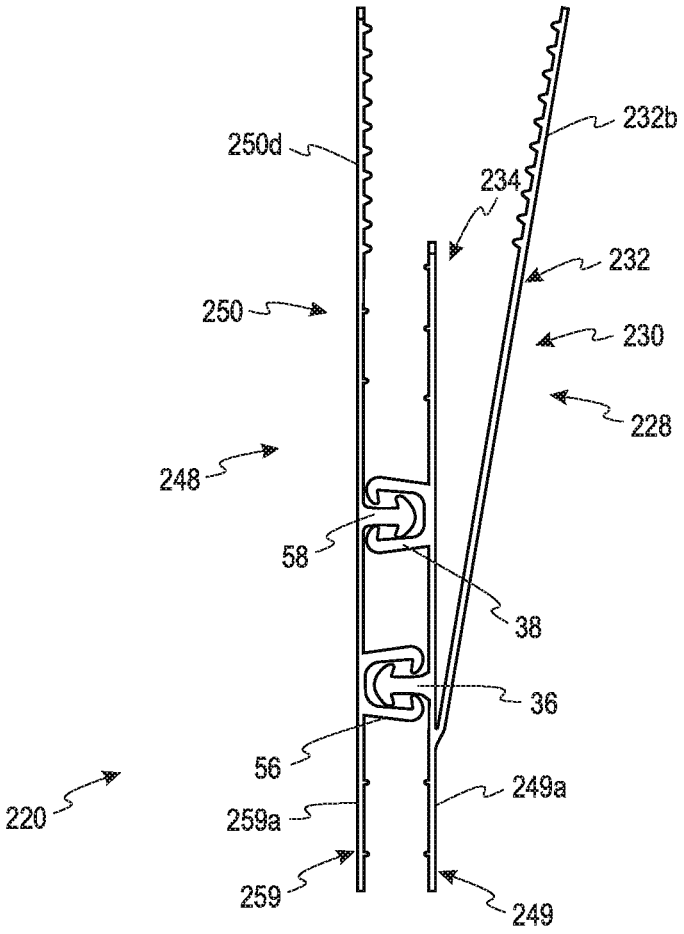
FIG. 3A shows a cross-sectional view of a zipper closure according to a further embodiment.
Figure 3B:
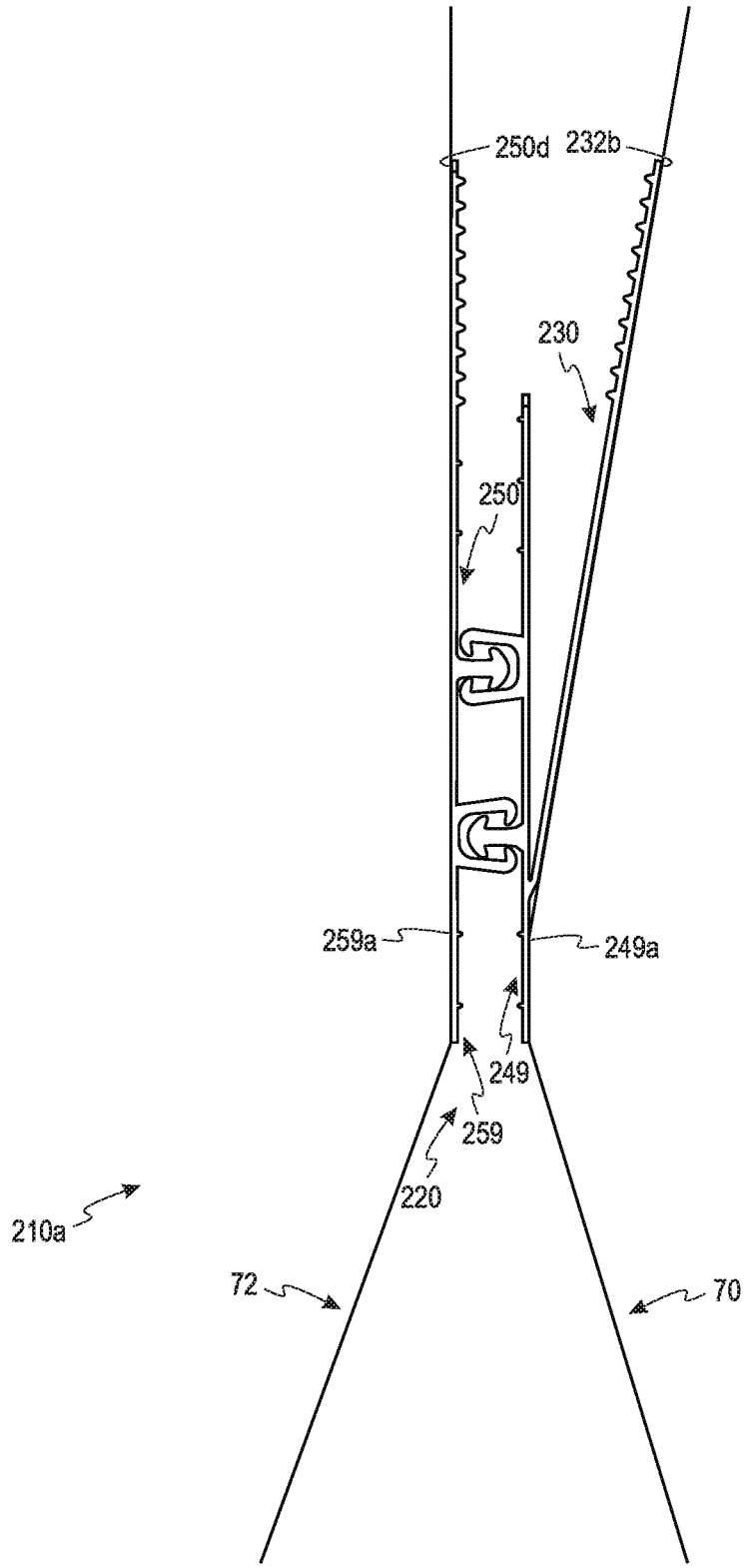
FIG. 3B shows a cross-sectional view of the zipper closure of FIG. 3A being used in a polymeric bag or package according to one embodiment.
Figure 3C:
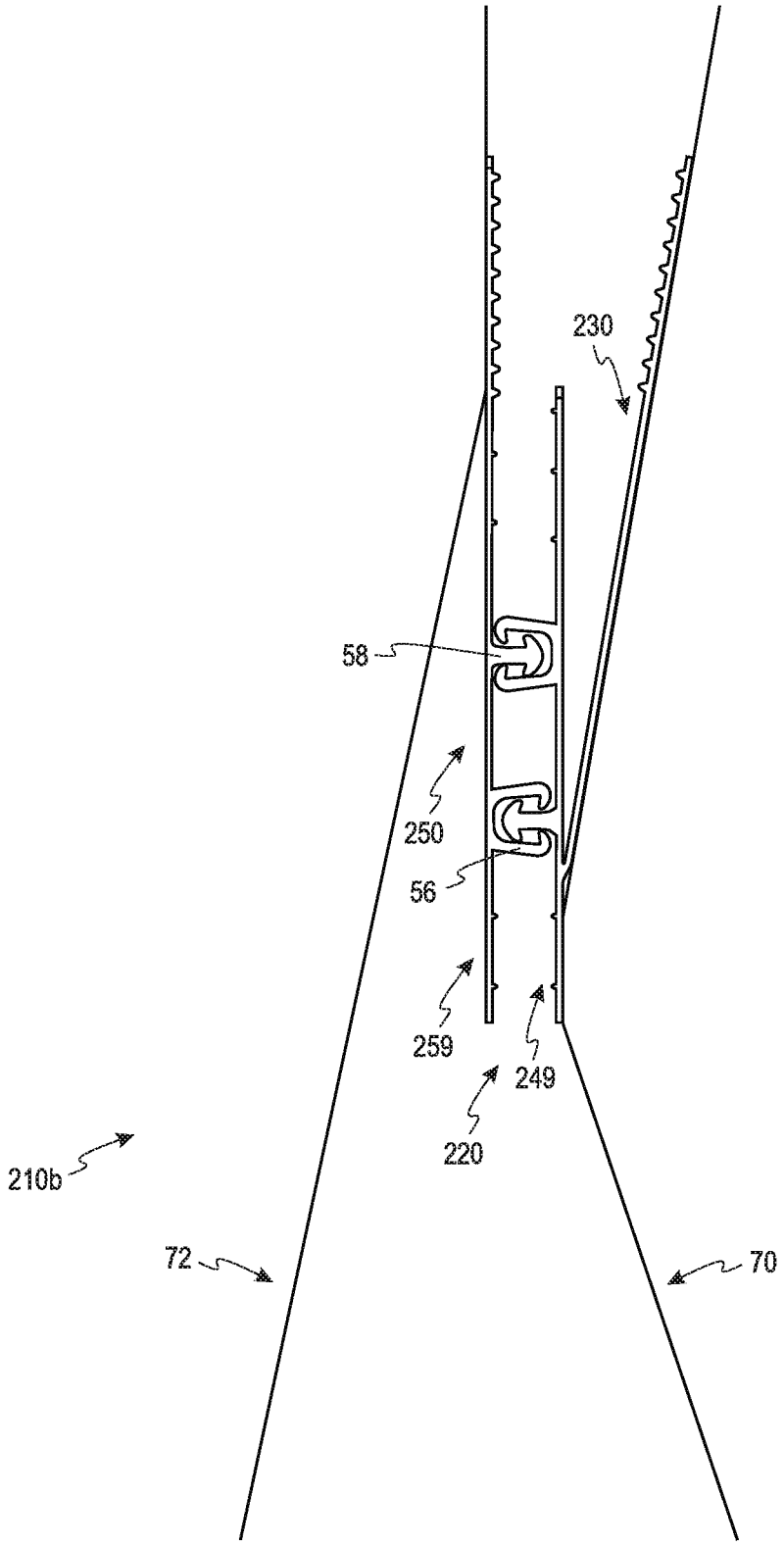
FIG. 3C shows a cross-sectional view of the zipper closure of FIG. 3A being used in a polymeric bag or package according to another embodiment.

Referring to FIGS. 3A-3C, a zipper closure 220 includes a first closure strip 228 and a second closure strip 248. The first closure strip 228 and the second closure strip 248 are similar to the first and second closure strips 28, 48, respectively, described above with respect to the closure 20 of FIGS. 1A, 1B. The first closure strip 228 includes a flange 230, the first closure profile 36 and the second closure profile 38. The flange 230 includes an outer flange portion 232, an inner flange portion 234 and a flange extension 249. The second closure strip 248 includes a flange 250, the first closure profile 56 and the second closure profile 58. The flange 250 includes a flange extension 259. The main differences between the first and second closure strips 228, 248 and the first and second closure strips 28, 48, respectively, are the flange extensions 249, 259.

FIG. 3B shows the zipper closure 220 being attached to the first and second opposing body panels 70, 72 to form a bag or package 210*a*. Specifically, an exterior surface 232*b* of the outer flange portion 232 is attached the first body panel 70, while an exterior surface area 250*d* of the flange 250 is attached to the second body panel 72 in forming the bag or package 210*a*. The attachment of the flanges 230, 250 to the opposing body panels 70, 72, respectively, extends along the entire length thereof. The flange extensions 249, 259 provide an additional surface area for sealing the zipper closure 220 to the body panels 70, 72. As shown in FIG. 3B, exterior surfaces 249*a*, 259*a* of respective flange extensions 249, 259 are attached to respective first and second body panels 70, 72. It is contemplated that the attachment may occur on less than the entire length of the flanges of the first and second closure strips. As discussed above, the attachment of the zipper closures to the opposing body panels may be performed using, for example, heat sealing and adhesives.

FIG. 3C shows an alternative embodiment of forming a package using the zipper closure 220. A package 210*b* is formed by attaching the zipper closure 220 to body panels 70, 72. The second body panel 72 is attached to the flange 250 at only a location spaced away from the first and second closure profiles 56, 58 (i.e., at an opposite of the flange extension 259). The first body panel 70 is attached to the flange 230 in a similar manner as described above in FIG. 3B.

Figure 4A:
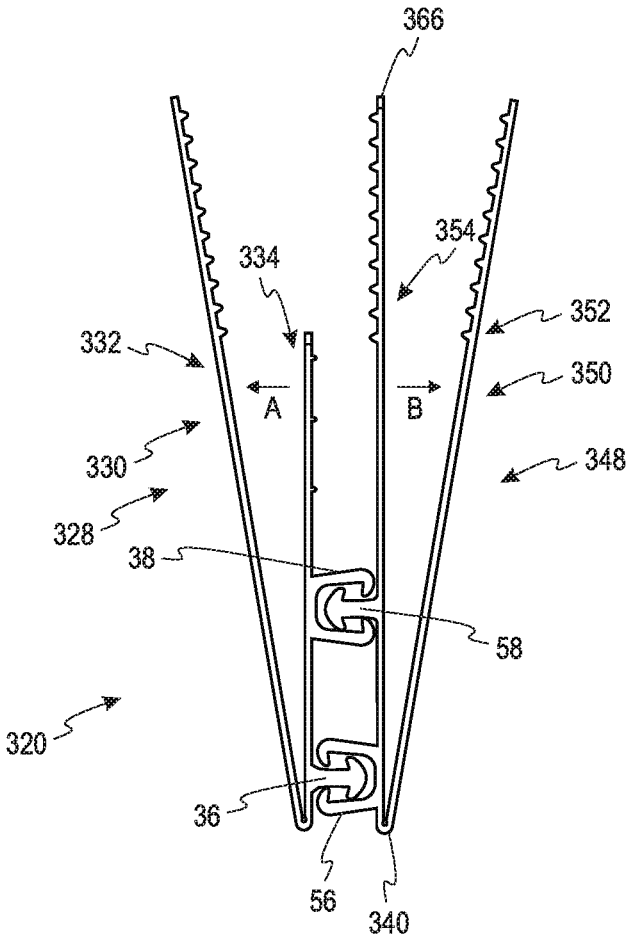
FIG. 4A shows a cross-sectional view of a zipper closure according to yet another embodiment.
Figure 4B:
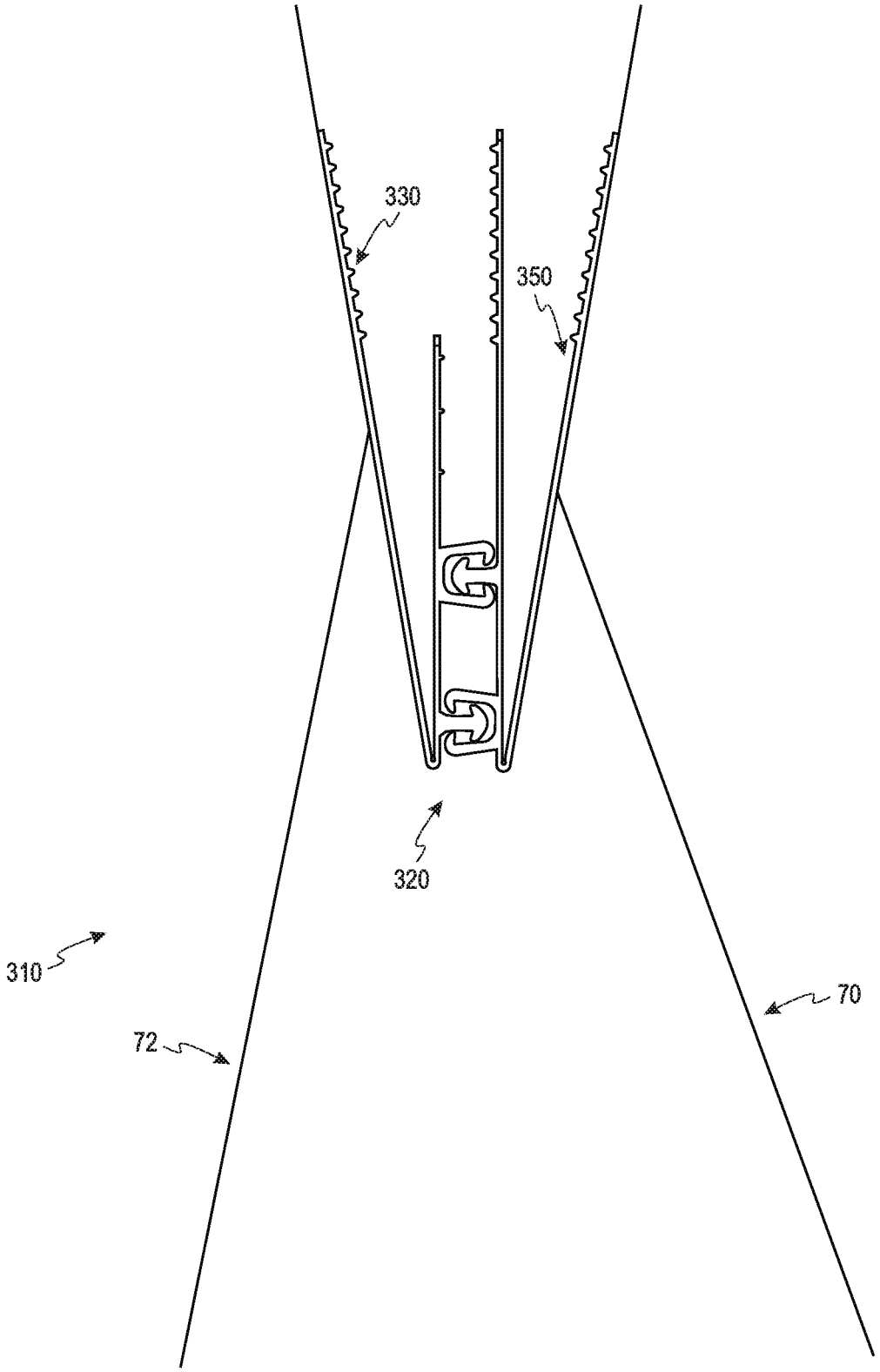
FIG. 4B shows a cross-sectional view of the zipper closure of FIG. 4A being used in a polymeric bag or package according to one embodiment.

Referring to FIGS. 4A, 4B, a zipper closure 320 includes a first closure strip 328 and a second closure strip 348. The first closure strip 328 includes a flange 330, a first closure profile 36 and a second closure profile 38. The flange 330 includes a first flange portion or outer flange portion 332 and a second flange portion or inner flange portion 334. The first closure strip 328 is similar to the first closure strip 28 of FIG. 1A except that the inner flange portion 334 of the first closure strip 328 is not bent towards the outer flange portion 332.

The second closure strip 348 includes a flange 350, the first closure profile 56 and the second closure profile 58. The flange 350 includes a first flange portion or outer flange portion 352 and a second flange portion or inner flange portion 354. The outer flange portion 352 encompasses and is integrally connected with the inner flange portion 354 at a bending point 340. In the orientation of FIG. 4A, the bending point 340 is slightly below the first closure profile 56. The first and second closure profiles 56, 58 of FIG. 4A are located between an open end 366 of the inner flange portion 354 and the bending point 340. The lengths of the outer flange portion 352 and the inner flange portion 354 are about the same.

FIG. 4B shows the zipper closure 320 being attached to the first and second opposing body panels 70, 72 to form a bag or package 310. Specifically, the flange 350 is attached to the first body panel 70, while the flange 330 is attached to the second body panel 72 in forming the bag or package 310. The attachment of the flanges 350, 330 to the opposing body panels 70, 72, respectively, extends along a portion of the length of the flanges 350, 330 (i.e., at ends opposite of the profiles).

It is contemplated that the attachment may extend a longer distance or a shorter distance along the length of the respective flanges. The attachment of the zipper closures to the opposing body panels may be performed using, for example, heat sealing and adhesives.

Figure 5A:
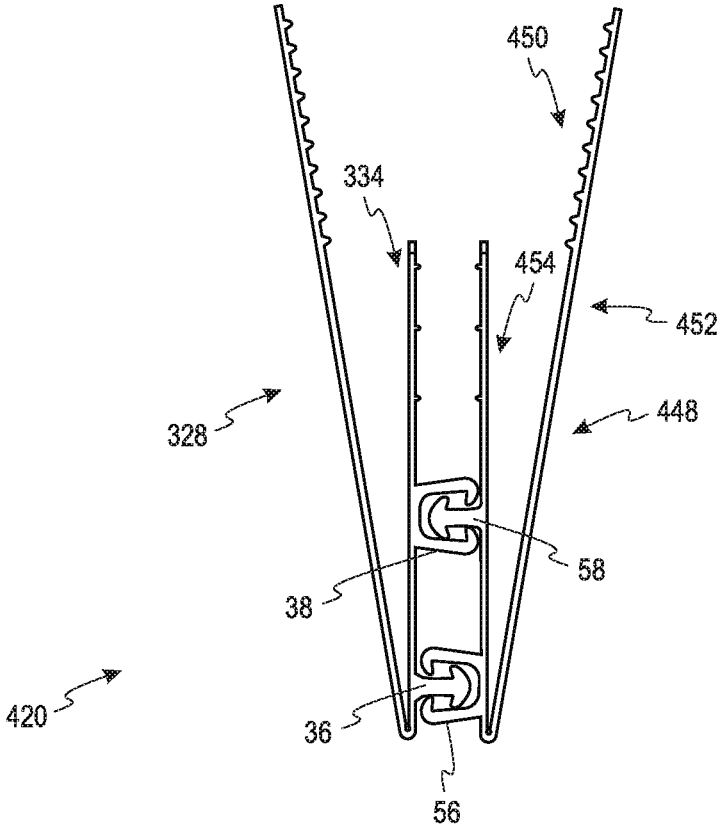
FIG. 5A shows a cross-sectional view of a zipper closure according to a further embodiment.
Figure 5B:
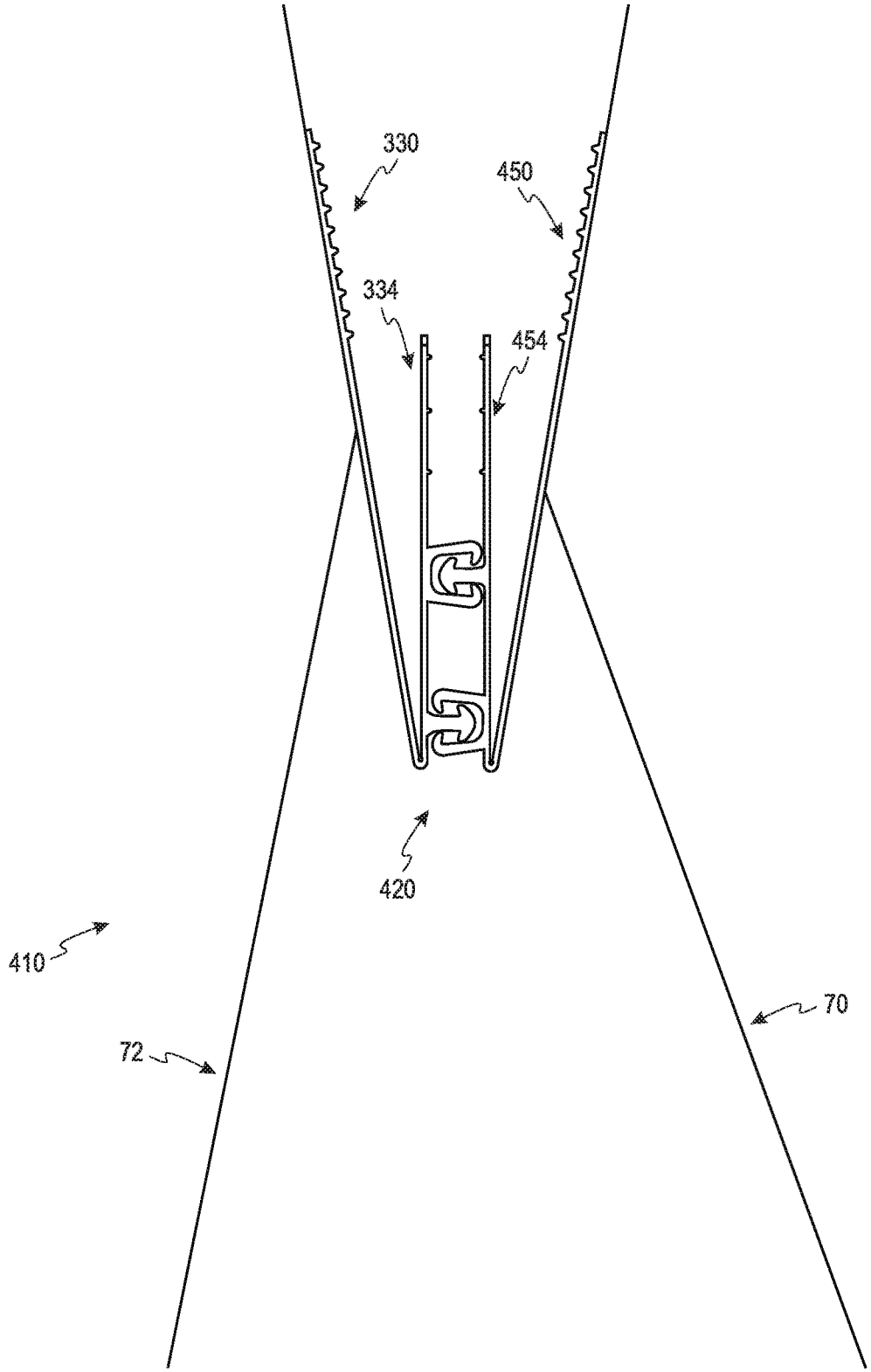
FIG. 5B shows a cross-sectional view of the zipper closure of FIG. 5A being used in a polymeric bag or package according to one embodiment.

Referring to FIGS. 5A, 5B, a zipper closure 420 includes the first closure strip 328 and a second closure strip 448. The first closure strip 328 is described with respect to FIG. 4A. The second closure strip 448 includes a flange 450, the first closure strip 56 and the second closure strip 58. The flange 450 includes a first flange portion or outer flange portion 452 and a second flange portion or inner flange portion 454. The second closure strip 448 is similar to the second closure strip 348 of FIG. 4A except that the inner flange portion 454 of the second closure strip 448 has a length similar to the length of the inner flange portion 334 of the first closure strip 328.

FIG. 5B shows the zipper closure 420 being attached to the first and second opposing body panels 70, 72 to form a bag or package 410. Specifically, the flange 450 is attached to the first body panel 70, while the flange 330 is attached to the second body panel 72 in forming the bag or package 410. The attachment of the flanges 450, 330 to the opposing body panels 70, 72, respectively, extends along a portion of the length of the flanges 450, 330.

Figure 6A:
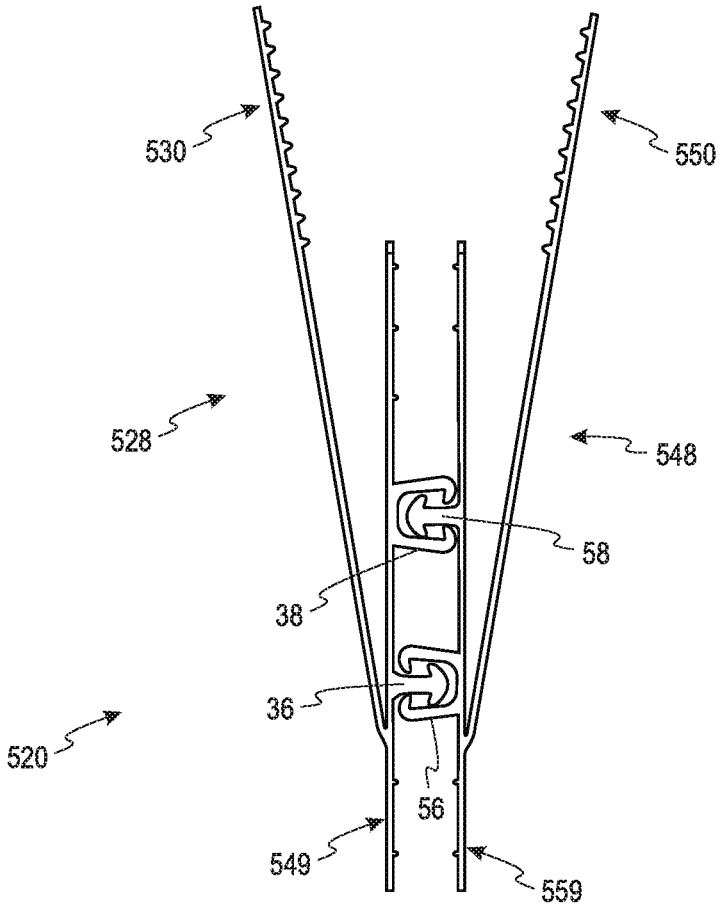
FIG. 6A shows a cross-sectional view of a zipper closure according to another embodiment.
Figure 6B:
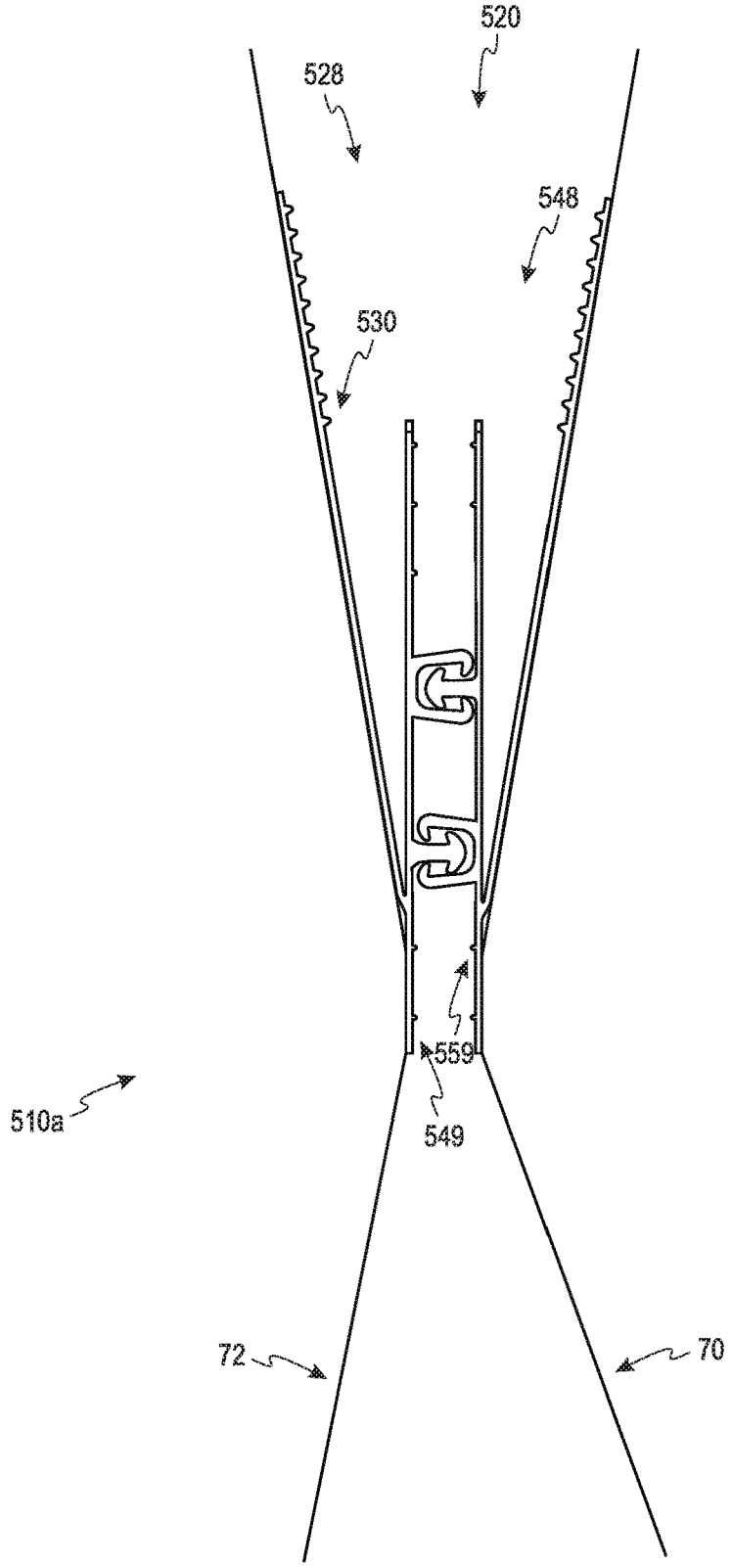
FIG. 6B shows a cross-sectional view of the zipper closure of FIG. 6A being used in a polymeric bag or package according to one embodiment.
Figure 6C:
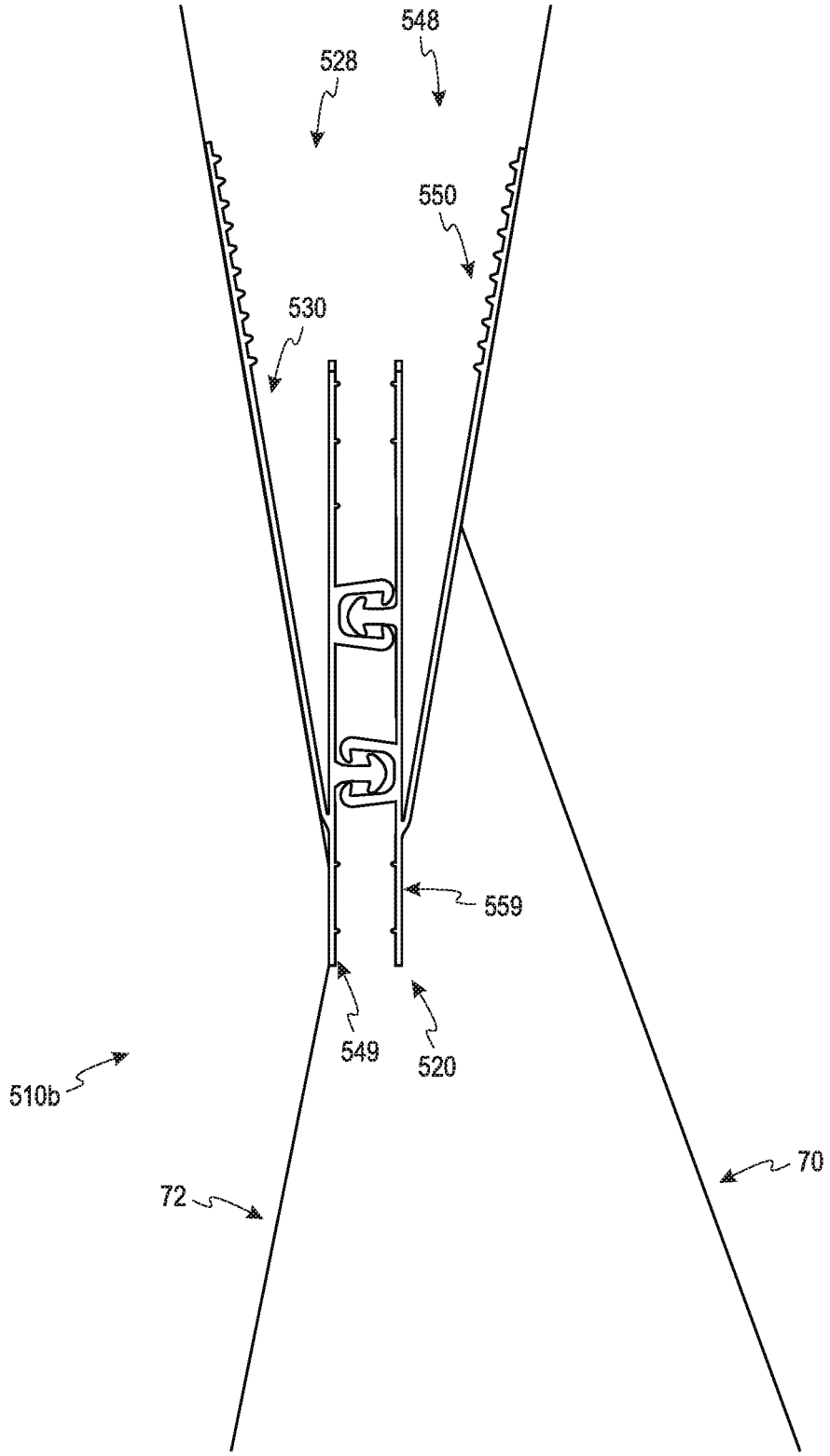
FIG. 6C shows a cross-sectional view of the zipper closure of FIG. 6A being used in a polymeric bag or package according to another embodiment.

Referring to FIGS. 6A-6C, a zipper closure 520 includes a first closure strip 528 and a second closure strip 548. The first and second closure strips 528, 548 include flanges 530, 550, respectively. The first and second closure strips 528, 548 are similar to the first and second closure strips 328, 448, respectively, of FIG. 5A. The first and second closure strips 528, 548, however, include flange extensions 549, 559, respectively. The flange extensions 549, 559 function in the same manner as described above with flange extensions 249, 259.

FIG. 6B shows the zipper closure 520 being attached to the first and second opposing body panels 70, 72 to form a bag or package 510*a*. Specifically, the flange 550 is attached to the first body panel 70, while the flange 530 is attached to the second body panel 72 in forming the bag or package 510*a*. The flange extensions 549, 559 are attached to the first and second body panels 70, 72, respectively. The attachment of the flanges 550, 530 to the opposing body panels 70, 72, respectively, extends along the entire length of the flanges 550, 530.

FIG. 6C shows the zipper closure 520 being attached to the first and second opposing body panels 70, 72 to form a bag or package 510*b*. Specifically, the flange 550 is attached to the first body panel 70, while the flange 530 is attached to the second body panel 72 in forming the bag or package 510*b*. The flange extension 549 is attached to the second body panel 72. The attachment of the flange 530 to the second body panel 72 extends along the entire length of the flange 530. The attachment of the flange 550 to the first body panel 70 extends along a portion of the length of the flange 550 (i.e., at an end opposition of the flange extension 559).

Figure 7A:
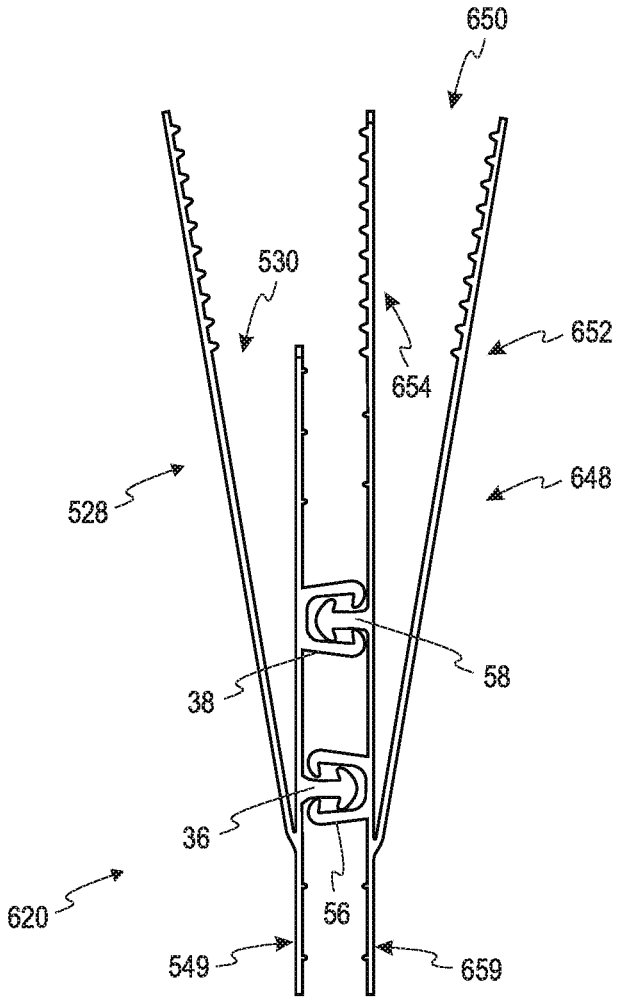
FIG. 7A shows a cross-sectional view of a zipper closure according to another embodiment.
Figure 7B:
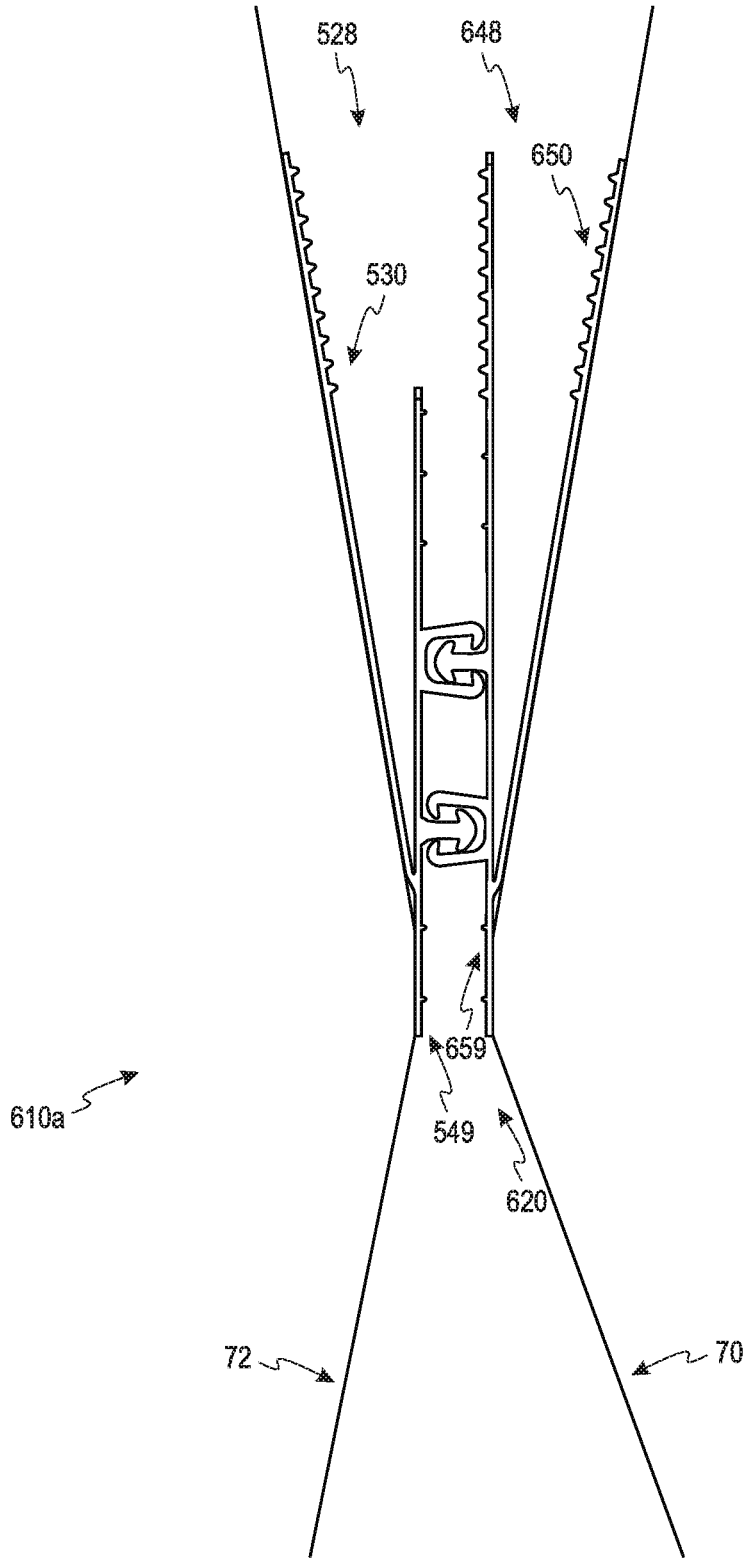
FIG. 7B shows a cross-sectional view of the zipper closure of FIG. 7A being used in a polymeric bag or package according to one embodiment.
Figure 7C:
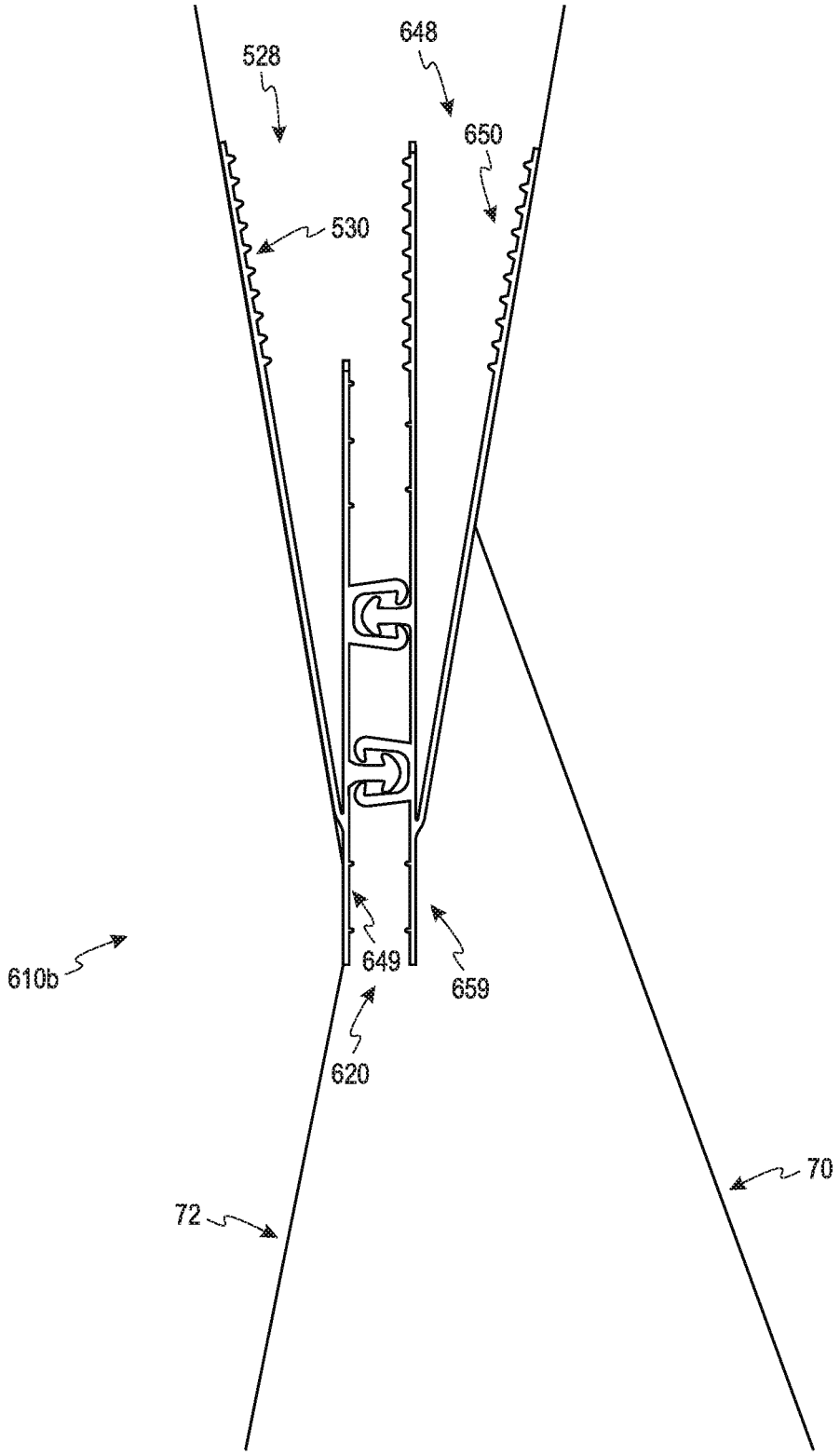
FIG. 7C shows a cross-sectional view of the zipper closure of FIG. 7A being used in a polymeric bag or package according to another embodiment.

Referring to FIGS. 7A-7C, a zipper closure 620 includes the first closure strip 528 and a second closure strip 648. The first closure strip 528 is described with respect to FIG. 6A. The second closure strip 648 includes a flange 650. The flange 650 includes an outer flange portion 652, an inner flange portion 654 and a flange extension 659. The second closure strip 648 is similar to the second closure strip 548 of FIG. 6A. The length of the inner flange portion 654 in FIG. 7A, however, is substantially the same as the length to the outer flange portion 652.

FIG. 7B shows the zipper closure 620 being attached to the first and second opposing body panels 70, 72 to form a bag or package 610*a*. Specifically, the flange 650 is attached to the first body panel 70, while the flange 530 is attached to the second body panel 72 in forming the bag or package 610*a*. The flange extensions 659, 649 are attached to the first and second body panels 70, 72, respectively. The attachment of the flanges 650, 530 to the first and second body panels 70, 72, respectively, extends along the entire length of the flanges 650, 530.

FIG. 7C shows the zipper closure 620 being attached to the first and second opposing body panels 70, 72 to form a bag or package 610*b*. Specifically, the flange 650 is attached to the first body panel 70, while the flange 530 is attached to the second body panel 72 in forming the bag or package 610*b*. The attachment of the flange 530 to the second body panel 72 extends along the entire length of the flange 530. The attachment of the flange 650 to the first body panel 70 extends along a portion of the length of the flange 650.

Figure 8A:
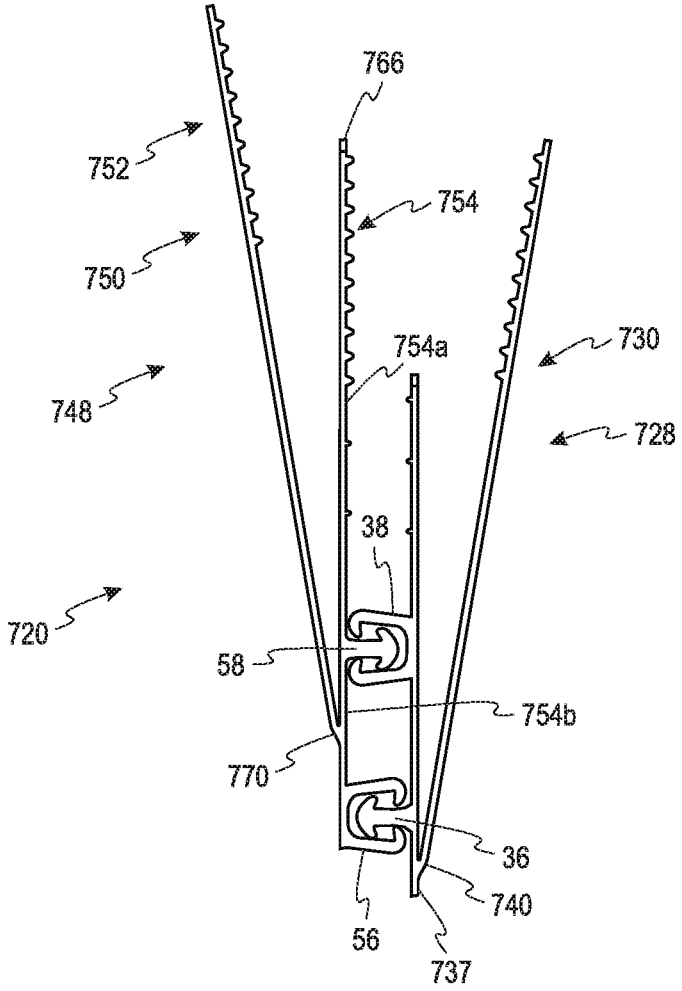
FIG. 8A shows a cross-sectional view of a zipper closure according to yet another embodiment.
Figure 8B:
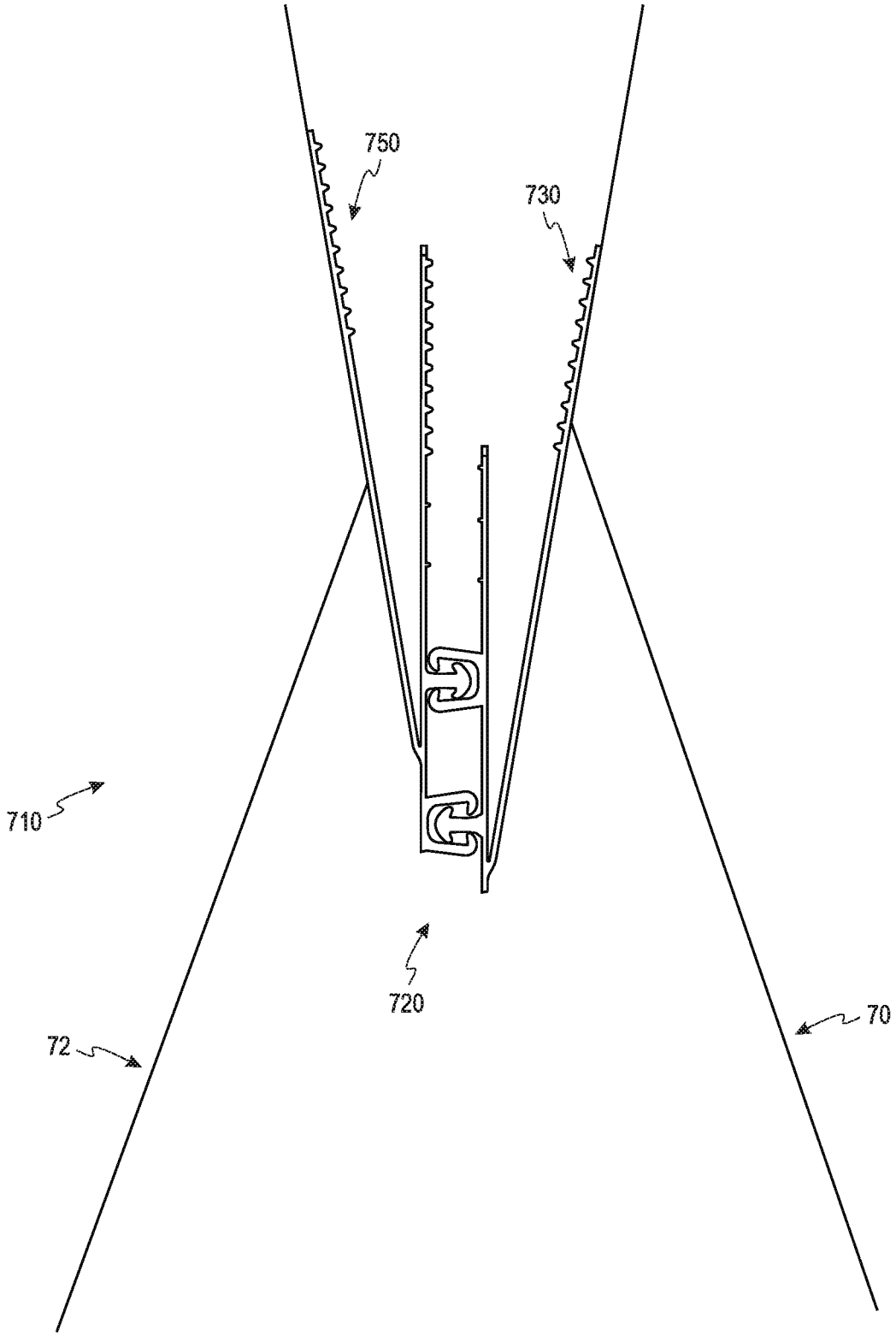
FIG. 8B shows a cross-sectional view of the zipper closure of FIG. 8A being used in a polymeric bag or package according to one embodiment.

Referring to FIGS. 8A and 8B, a zipper closure 720 includes a first closure strip 728 and a second closure strip 748. The first closure strip 728 includes a flange 730, the first closure profile 36 and the second closure profile 38. The first closure strip 728 is similar to the first closure strip 328 described with respect to FIG. 5A, except that the first closure strip 728 includes a small extension 737 extending from a bending point 740.

The second closure strip 748 includes a flange 750, the first closure profile 56 and the second closure profile 58. The flange 750 includes a first flange portion or outer flange portion 752 and a second flange portion or inner flange portion 754. The inner flange portion 754 includes the first closure profile 56 and the second closure profile 58, which are configured to interlock with respective first and second closure profiles 36, 38 of the second closure strip 728. As shown in FIG. 8A, the inner flange portion 754 includes an inner flange section 754*a* that extends above the first and second closure profiles 56, 58, and an inner flange section 754*b* that extends between the first and second closure profiles 56, 58.

The outer flange portion 752 encompasses and is integrally connected with the inner flange portion 754 at a bending point 770. In the orientation of FIG. 8A, the bending point 770 is located between the first and second closure profiles 56, 58. The second closure profile 58 of FIG. 8A is located between an open end 766 of the inner flange portion 754 and the bending point 770.

FIG. 8B shows the zipper closure 720 being attached to the first and second opposing body panels 70, 72 to form a bag or package 710. Specifically, the flange 730 is attached to the first body panel 70, while the flange 750 is attached to the second body panel 72 in forming the bag or package 710. The attachments of the flanges 730, 750 to the opposing body panels 70, 72, respectively, extend along a portion of the length of the flanges 750, 730.

It is contemplated that the first and second closure strips may include at least one or exactly one closure profile, respectively, in any of the configurations of the zipper closures described above. It is also contemplated that the first and second closure strips may include more than two closure profiles in any of the configurations described above. For example, the first and second closure strips may each have three or even four closure profiles.

Figure 9A:
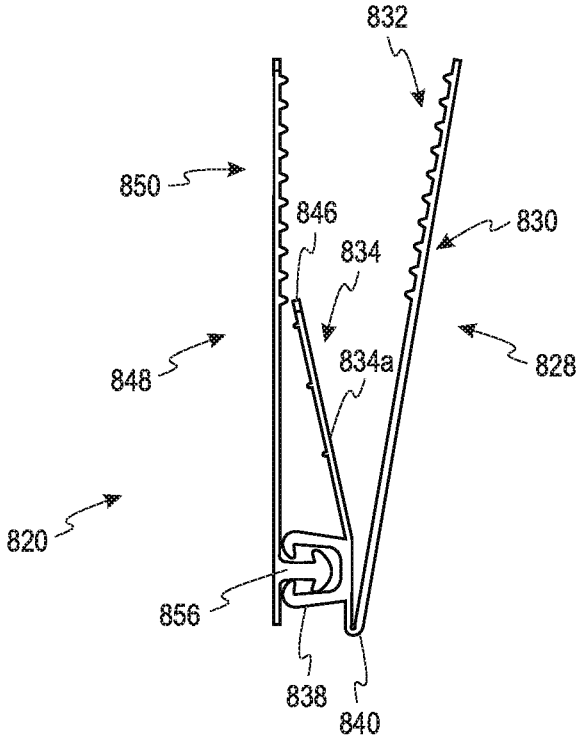
FIG. 9A shows a cross-sectional view of a zipper closure according to a further embodiment.
Figure 9B:
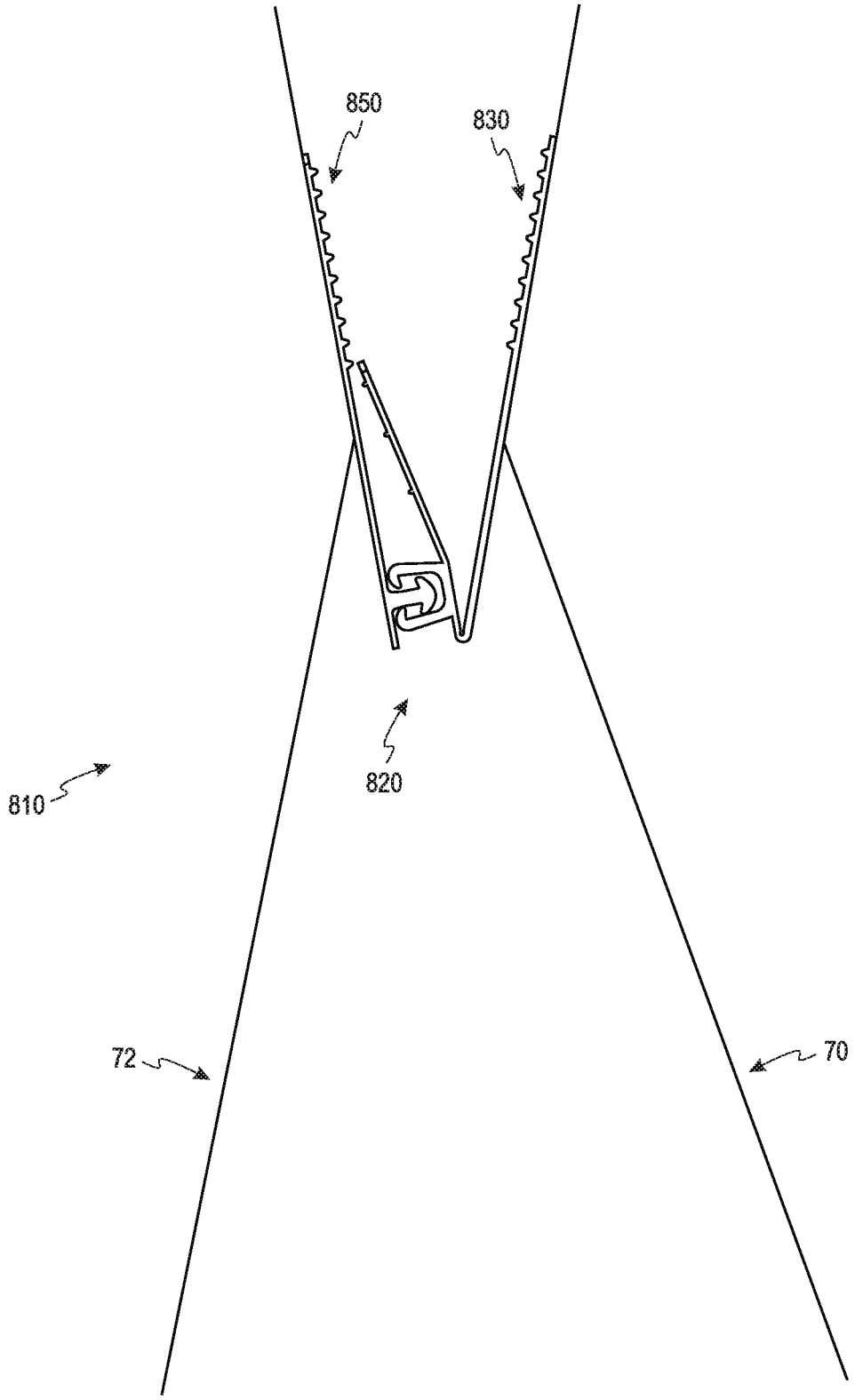
FIG. 9B shows a cross-sectional view of the zipper closure of FIG. 9A being used in a polymeric bag or package according to one embodiment.

A non-limiting example of a closure strip having exactly one interlocked closure profile is shown in FIGS. 9A, 9B. In FIGS. 9A, 9B, a zipper closure 820 includes a first closure strip 828 and a second closure strip 848.

The first closure strip 828 includes a flange 830 and a closure profile 838. The flange 830 includes a first flange portion or outer flange portion 832 and a second flange portion or inner flange portion 834. The inner flange portion 834 includes the first closure profile 838. As shown in FIG. 9A, the inner flange portion 834 includes an inner flange section 834*a* that extends above the closure profile 838. The outer flange portion 832 encompasses and is integrally connected with the inner flange portion 834 at a bending point 840. In the orientation of FIG. 9A, the closure profile 838 is located between the bending point 840 and an open end 846 of the inner flange portion 834.

The second closure strip 848 includes a flange 850 and a closure profile 856. The closure profile 838 of the first closure strip 828 is configured to interlock with the closure profile 856 of the second closure strip 848.

FIG. 9B shows the zipper closure 820 being attached to the first and second opposing body panels 70, 72 to form a bag or package 810. Specifically, the flange 830 is attached to the first body panel 70, while the flange 850 is attached to the second body panel 72 in forming the bag or package 810. The attachments of the flanges 830, 850 to the first and second body panels 70, 72, respectively, extend along a portion of the length of the flanges 830, 850.

Figure 10A:
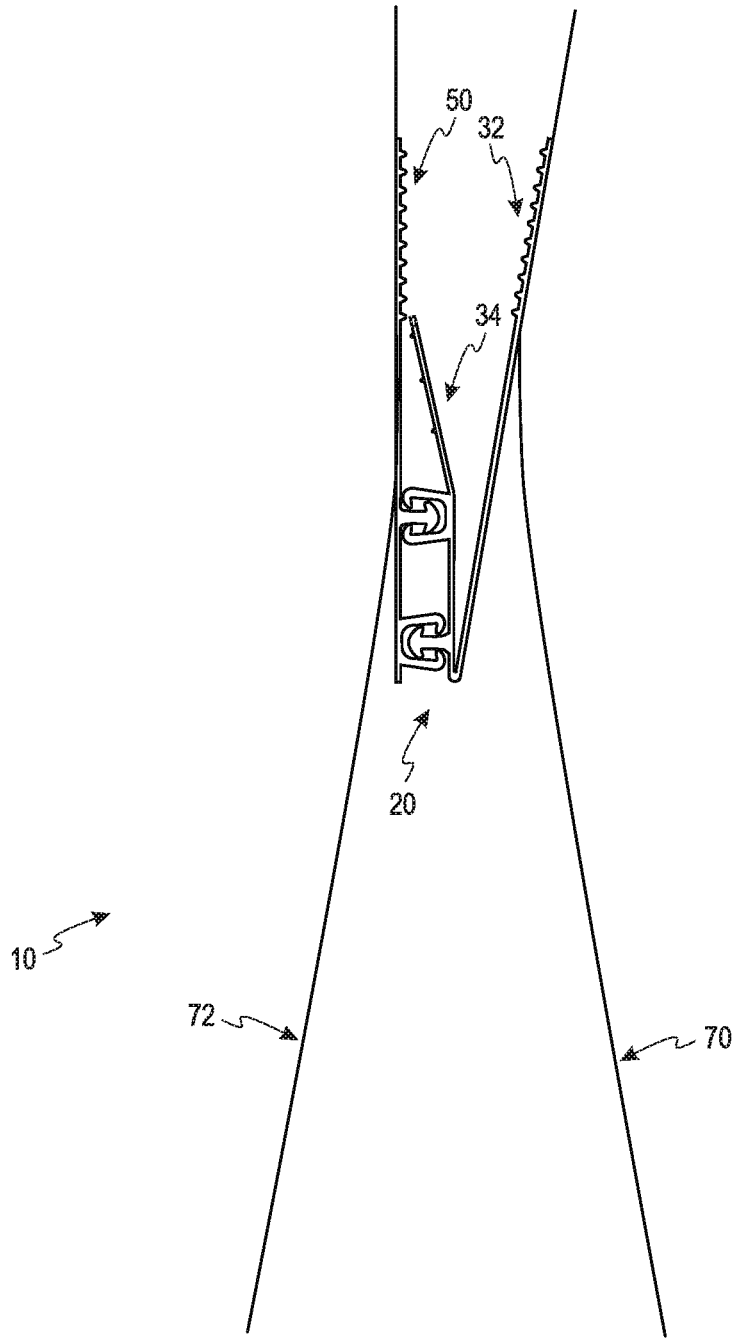
FIG. 10A is the first step of a sequence for opening the zipper closure of FIG. 1A according to one method.
Figure 10B:
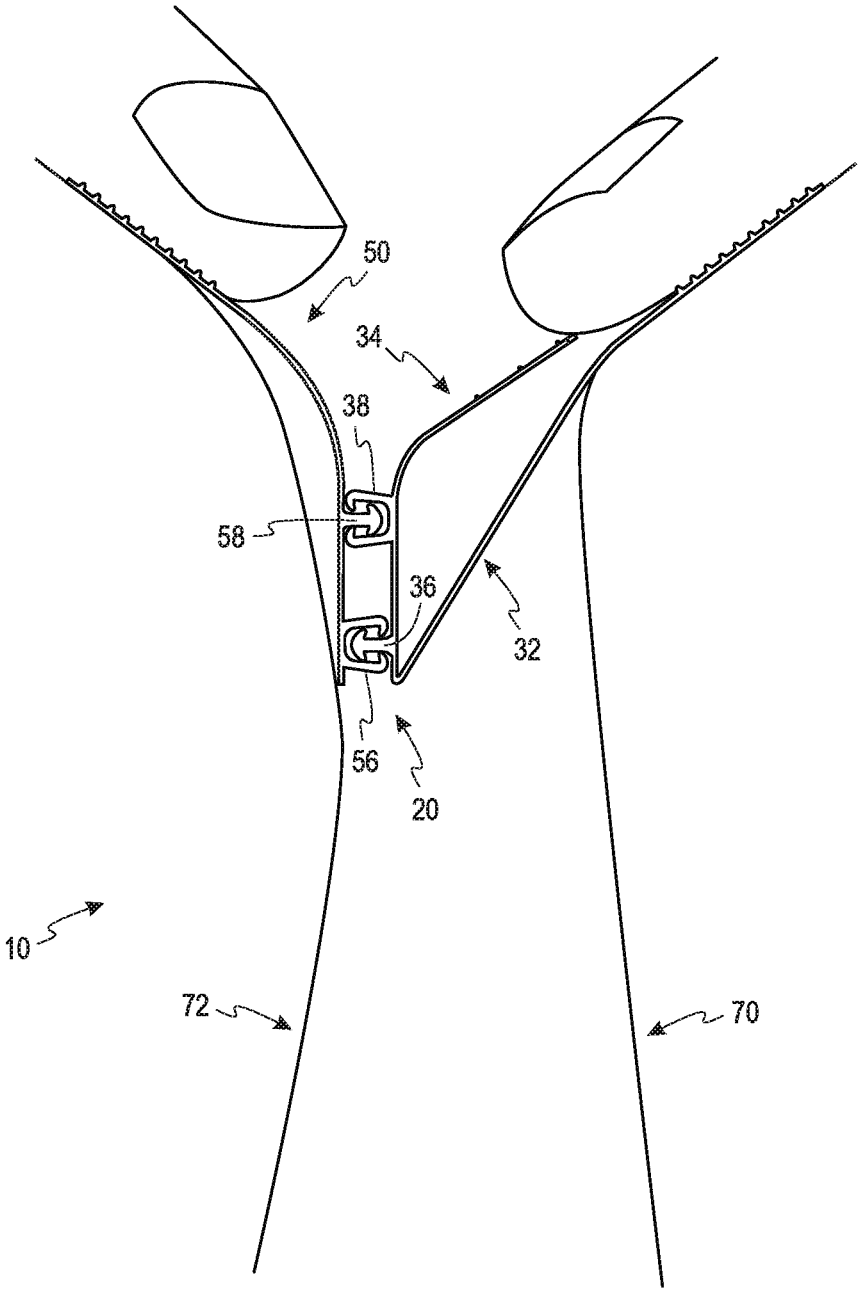
FIG. 10B is the second step of a sequence for opening the zipper closure of FIG. 1A according to one method.

The process of opening the zipper closures of the present invention is shown in, for example, the sequence depicted in FIGS. 10A-D according to one method. The zipper closure 20 of FIG. 1A of the bag or package 10 is depicted in FIGS. 10A-D. FIG. 10A shows the bag or package 10 and the zipper closure 20 before a user begins opening the bag or package 10. FIG. 10B depicts a user using his or her fingers or thumbs to begin opening the bag or package 10. The user places or positions his or her thumbs on the inside of the shorter inner flange portion 34 and the flange 50 above the interlocked first closure profiles 36, 56 and the interlocked second closure profiles 38, 58.

Figure 10C:
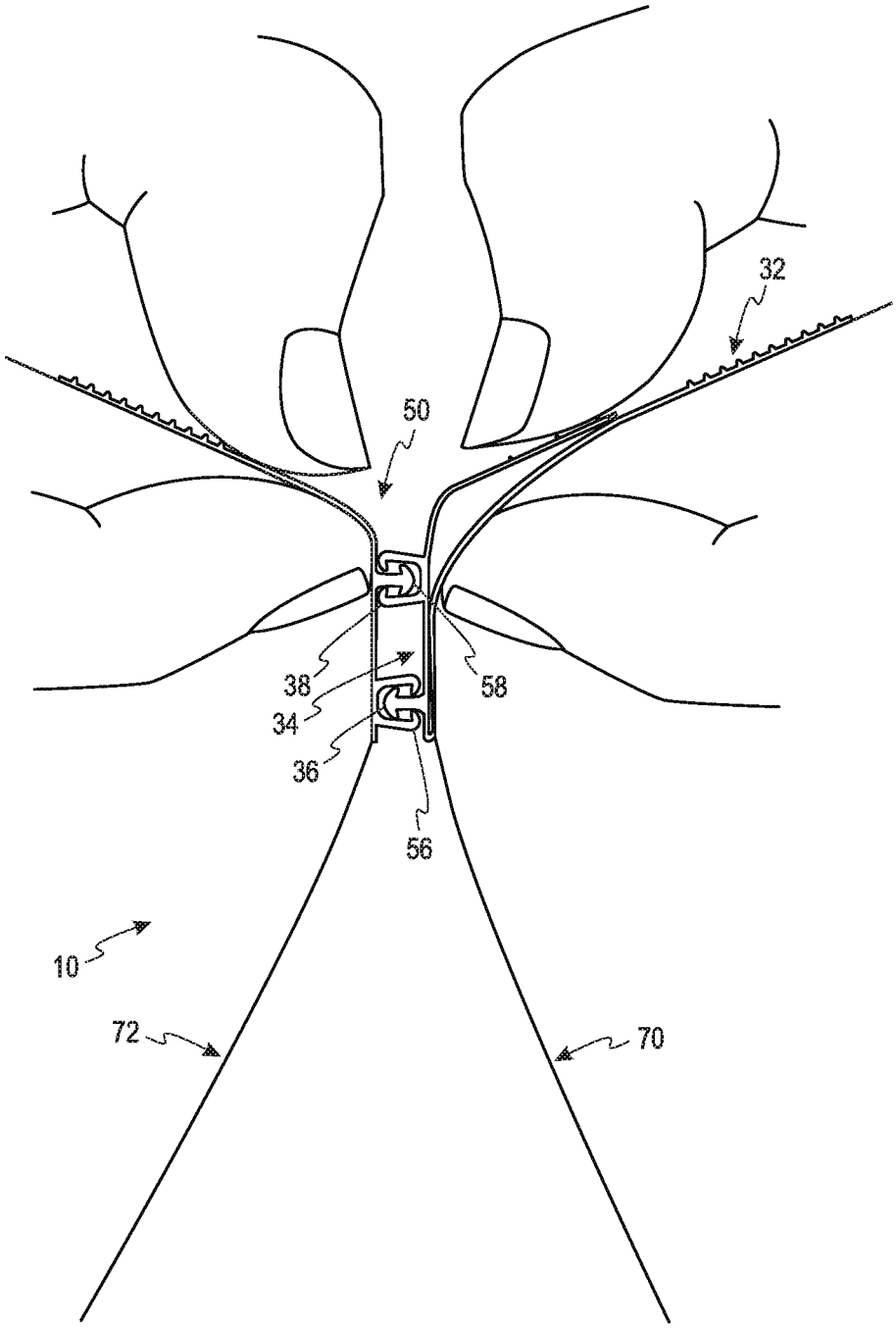
FIG. 10C is the third step of a sequence for opening the zipper closure of FIG. 1A according to one method.
Figure 10D:
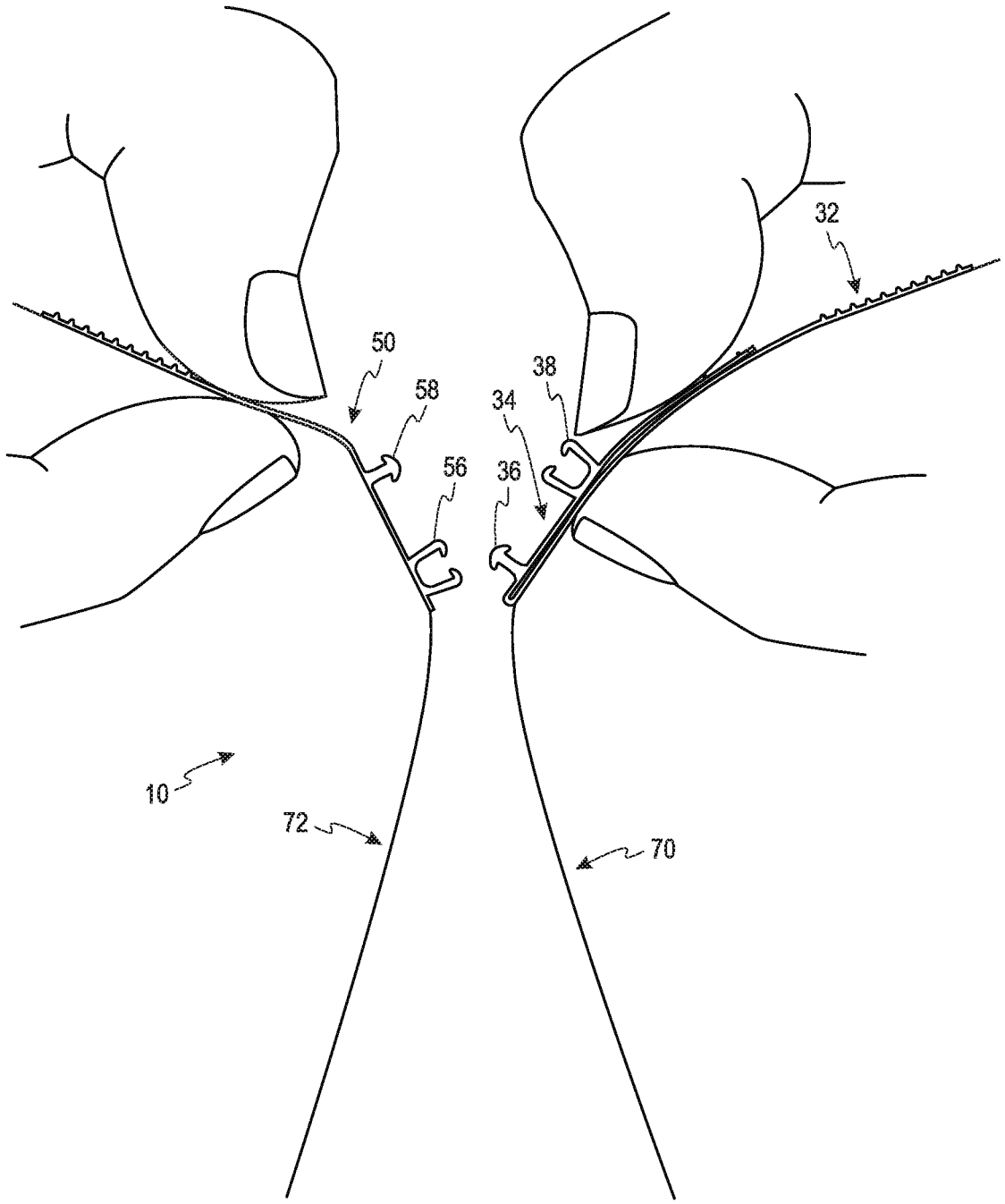
FIG. 10D is the fourth step of a sequence for opening the zipper closure of FIG. 1A according to one method.

Referring to FIGS. 10C, 10D, the user while gripping the shorter inner flange portion 34 and the flange 50, pulls and pivots the thumbs outwardly to open the interlocked first closure profiles 36, 56 and the interlocked second closure profiles 38, 58. The user desirably pivots the thumbs outwardly in a simultaneously fashion for an efficient opening. After the first and second profiles have been disengaged from each other (i.e., opened), then the contents of the bag or package 10 can be accessed.

If the user instead grasps the outer flange portion 32 in an attempt to open the bag or package 10, the closure profiles 36, 56 and 38, 58 will not open. Specifically, when the outer flange portion 32 is pulled, it results in the body panels or walls being parted while the zipper closure itself remains interlocked (i.e., in a closed position).

The process for opening the other zipper closures of the present invention are generally similar as described above with respect to the zipper closure 20 of FIGS. 10A-10D. For example, referring to FIGS. 4A, 4B, a user would position his or her thumbs on the insides of inner flange portions 334, 354 and then pull and pivot the thumbs outwardly (along direction of arrows A and B) to open the closure profiles 36, 56 and 38, 58. If a user pulls on outer flange portion 332 and/or outer flange portions 352, the bag or package 310 will not open. After the first and second profiles have been disengaged from each other (i.e., opened), then the contents of the bag or package 310 can be accessed.

The outer and inner flange portions may be formed by extrusion and then cooled in a water bath before being bent according to one process.

To assist in easier locating and identifying the inner flange portion(s) to grasp and pull outwardly to open the bag or package, the inner flange portion(s) of the closure profiles may include some particular markings on their respective ends. For example, the open end 46 of FIG. 1A may be marked by color or other markings to assist in locating or identifying the inner flange portion 34. An open end of the outer flange portion 48 may also be similar marked.

The zipper closures are typically made of polymeric material. Some non-limiting examples of polymeric material include, but are not limited to, polyethylene-based polymers, polystyrene, polypropylene, nylon, polycarbonate, other similar materials and combinations thereof. The polyethylene-based polymers may include, but are not limited to, low density polyethylene (LDPE), linear low density polyethylene (LLDPE), metallocene linear low density polyethylene (mLLDPE), ethyl vinyl acetate (EVA) or combinations thereof.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A package comprising:

first and second opposing body panels fixedly connected to each other along a pair of sides and a bottom bridging the pair of sides; and a zipper closure extending along a mouth formed opposite of the bottom, the zipper closure including a first closure strip and a second closure strip, the first closure strip comprising at least one closure profile and a flange, the second closure strip comprising at least one closure profile and a flange, the flange of the second closure strip having a first end and a second end, the first end of the flange of the second closure strip being closer to the mouth than the flange of the second end of the second closure strip, the flange of the second closure strip including an outer surface attached to the second body panel and an inner surface from which the at least one closure profile extends, the flange of the first closure strip including an outer flange portion and an inner flange portion, the outer flange portion of the first closure strip encompassing and being integrally connected to the inner flange portion of the first closure strip at a bending point, the inner flange portion of the first closure strip including the at least one closure profile, the inner flange portion of the first closure strip having a length less than a length of the outer flange portion of the first closure strip, wherein the at least one closure profile of the first closure strip and the at least one closure profile of the second closure strip are configured to interlock with each other, wherein each of the at least one closure profile of the first closure strip is located between an open end of the inner flange portion of the flange of the first closure portion and the bending point, wherein the outer surface of the flange of the second closure strip attached to the second body panel is attached between the first end of the flange of the second closure strip and the at least one closure profile of the second closure strip, wherein the outer surface of the flange of the second closure strip is unattached to the second body panel between the second end of the flange of the second closure strip and the at least one closure profile of the second closure strip, wherein the at least one closure profile of the first closure strip and the at least one closure profile of the second closure strip are configured to be unlocked by grasping and moving the flange of the second closure strip and the inner flange portion of the first closure strip from each other so as to open the package, wherein the at least one closure profile of the first closure strip and the at least one closure profile of the second closure strip are configured to remain interlocked when grasping and pulling the outer flange portion of the first closure strip outwardly and pulling the flange of the second closure strip outwardly.

2. The package of claim 1, wherein each of the at least one closure profile of the first closure strip and the second closure strip comprises a plurality of closure profiles.

3. The package of claim 2, wherein the outer surface of the flange of the second closure strip is unattached to the second body panel between the plurality of closure profiles of the second closure strip.

4. The package of claim 1, wherein the length of the inner flange portion of the first closure strip is about 30 to about 80 percent of the length of the outer flange portion of the first closure strip.

5. The package of claim 4, wherein the length of the inner flange portion of the first closure strip is about 40 to about 60 percent of the length of the outer flange portion of the first closure strip.

6. The package of claim 1, wherein the inner flange portion of the first closure portion is bent towards the flange of the second closure strip.

7. The package of claim 1, wherein the first and second closure strips include reinforcing notches.

8. The package of claim 1, wherein the flange of the first closure strip and the flange of the second closure strip include flange extensions.

9. The package of claim 1, wherein the inner flange portion and the outer flange portion of the first closure strip are at an angle of from about 15 to about 50 degrees with respect to each other.

10. The package of claim 1, wherein one of the at least one closure profiles is a female profile with a cross-section being U-shaped having ends of its arms being bent inward, and the other one of the at least one closure profiles is a male profile with a cross-section being arrowhead-shaped.

11. The package of claim 1, wherein one of the at least one closure profile of the first and second closure strips includes a plurality of female closure profiles and the other one of the at least one closure profile of the first and second closure strips includes a plurality of male closure profiles.

12. The package of claim 1, wherein each of the at least one closure profile of the first and second closure strips includes a male closure profile and a female closure profile.

13. The package of claim 1, wherein the zipper closure is a polymeric zipper closure, and wherein the first and second opposing body panels are first and second opposing polymeric body panels.

14. A package comprising:

first and second opposing body panels fixedly connected to each other along a pair of sides and a bottom bridging the pair of sides; and a zipper closure extending along a mouth formed opposite of the bottom, the zipper closure including a first closure strip and a second closure strip, the first closure strip comprises at least one closure profile and a flange, the second closure strip comprises at least one closure profile and a flange, the flange of the second closure strip having a first end and a second end, the first end of the flange of the second closure strip being closer to the mouth than the second end of the flange of the second closure strip, the flange of the second closure strip including an outer surface attached to the second body panel and an inner surface from which the at least one closure profile extends, the flange of the first closure strip including an outer flange portion and an inner flange portion, the outer flange portion of the first closure strip encompassing and being integrally connected to the inner flange portion of the first closure strip at a bending point, the inner flange portion of the first closure strip including the at least one closure profile, wherein the at least one closure profile of the first closure strip and the at least one closure profile of the second closure strip are configured to interlock with each other, wherein each of the at least one closure profile of the first closure strip is located between an open end of the inner flange portion of the first closure strip and the bending point, wherein the outer surface of the flange of the second closure strip attached to the second body panel is attached between the first end of the flange of the second closure strip and the at least one closure profile of the second closure strip, wherein the outer surface of the flange of the second closure strip is unattached to the second body panel between the second end of the flange of the second closure strip and the at least one closure profile of the second closure strip, wherein the at least one closure profile of the first closure strip and the at least one closure profile of the second closure strip are configured to be unlocked by grasping and moving the flange of the second closure strip and the inner flange portion of the first closure strip from each other, wherein the at least one closure profile of the first closure strip and the at least one closure profile of the second closure strip are configured to remain interlocked when grasping and pulling the outer flange portion of the first closure strip outwardly and pulling the flange of the second closure strip outwardly.

15. The package of claim 14, wherein each of the at least one closure profile of the first closure strip and the second closure strip comprises a plurality of closure profiles.

16. The package of claim 15, wherein the outer surface of the flange of the second closure strip is unattached to the second body panel between the plurality of closure profiles of the second closure strip.

17. The package of claim 14, wherein the inner flange portion of the first closure portion is bent towards the flange of the second closure strip.

18. The package of claim 14, wherein the first and second closure strips include reinforcing notches.

19. The package of claim 14, wherein the inner flange portion and the outer flange portion of the first closure strip are at an angle of from about 15 to about 50 degrees with respect to each other.

20. The package of claim 14, wherein the zipper closure is a polymeric zipper closure, and wherein the first and second opposing body panels are first and second opposing polymeric body panels.

* * * * *